US012344355B2

(12) United States Patent
Schier et al.

(10) Patent No.: US 12,344,355 B2
(45) Date of Patent: Jul. 1, 2025

(54) WATERCRAFT WITH ADJUSTABLE TOWER ASSEMBLY

(71) Applicant: Arc Boat Company, San Francisco, CA (US)

(72) Inventors: Michael Schier, San Francisco, CA (US); Dylan Anderson, San Francisco, CA (US); Peter Mitchell, San Francisco, CA (US)

(73) Assignee: Arc Boat Company, San Francisco, CA (US)

( * ) Notice: Subject to any disclaimer, the term of this patent is extended or adjusted under 35 U.S.C. 154(b) by 0 days.

(21) Appl. No.: 18/789,905

(22) Filed: Jul. 31, 2024

(65) Prior Publication Data

US 2025/0042512 A1 Feb. 6, 2025

Related U.S. Application Data

(60) Provisional application No. 63/555,237, filed on Feb. 19, 2024, provisional application No. 63/516,898, filed on Aug. 1, 2023.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 6,860,222 | B2 * | 3/2005 | Himmel | B63B 17/02 114/361 |
| 6,983,716 | B1 | 1/2006 | Ankney et al. | |
| 7,159,531 | B2 * | 1/2007 | Baylor | B63B 17/02 114/361 |
| 8,025,194 | B2 | 9/2011 | Jesewitz | |
| 8,056,497 | B1 | 11/2011 | Rondeau et al. | |
| 8,196,542 | B2 | 6/2012 | Oswell et al. | |
| 8,205,571 | B1 | 6/2012 | Rondeau et al. | |
| 8,297,484 | B2 | 10/2012 | Jesewitz et al. | |
| 8,555,802 | B2 | 10/2013 | Oswell et al. | |

(Continued)

FOREIGN PATENT DOCUMENTS

| | | |
|---|---|---|
| CN | 211055330 U | 7/2020 |
| CN | 218258592 U | 1/2023 |
| WO | 2009021560 A1 | 2/2009 |

OTHER PUBLICATIONS

International Search Report & Written Opinion for PCT/US2024/040271, mailed Jan. 22, 2025, 16 pages.

(Continued)

*Primary Examiner* — Lars A Olson
(74) *Attorney, Agent, or Firm* — CASIMIR JONES, S.C.; Brian F. Bradley

(57) ABSTRACT

A watercraft comprising a hull, a roof, a support including a first end coupled to the roof and a second end positioned within the hull, and an actuation assembly coupled to the support. The support is moveable between a first position and a second position in response to activation of the actuation assembly. The support extends into the hull a first distance in the first position and a second distance in the second position. The second distance is larger than the first distance.

34 Claims, 24 Drawing Sheets

(56) References Cited

U.S. PATENT DOCUMENTS

| | | | |
|---|---|---|---|
| 9,156,528 | B2 | 10/2015 | Jesewitz |
| 9,180,943 | B2 | 11/2015 | Oswell et al. |
| 9,580,155 | B2 | 2/2017 | Lake et al. |
| 9,849,946 | B1 | 12/2017 | Bohanan et al. |
| 10,150,540 | B2 | 12/2018 | Lake et al. |
| 10,207,778 | B1 | 2/2019 | Bohanan et al. |
| 10,286,982 | B2 | 5/2019 | Sheedy et al. |
| 10,532,798 | B1 | 1/2020 | Bohanan et al. |
| 10,800,493 | B2 | 10/2020 | Sheedy et al. |
| 11,046,397 | B2 | 6/2021 | Oswell et al. |
| 11,383,798 | B2 | 7/2022 | Wilson et al. |
| 11,708,129 | B2 | 7/2023 | Wilson et al. |
| 11,932,352 | B2 | 3/2024 | Oswell et al. |
| 2019/0375484 | A1 | 12/2019 | Wilson |

OTHER PUBLICATIONS

Varatti. Powered Sport Top. Retrieved from https://varattiboats.com/ on Mar. 21, 2024. 1 page.

Varatti Boats Powered Sport Top. Feb. 16, 2024. Retrieved from https://youtu.be/_D2nxJ_jHhc on Oct. 16, 2024. 1 page.

* cited by examiner

WATERCRAFT WITH ADJUSTABLE TOWER ASSEMBLY

CROSS-REFERENCE TO RELATED APPLICATIONS

This application claims the benefit of priority to U.S. Provisional Patent Application No. 63/516,898, filed Aug. 1, 2023, and U.S. Provisional Patent Application No. 63/555,237, filed Feb. 19, 2024, which are hereby incorporated by reference in their entirety.

TECHNICAL FIELD

This disclosure relates to tower assemblies (e.g., wakeboard towers) for watercraft (e.g., boats) and methods of using the same.

BACKGROUND

Boat towers are used for a number of purposes where elevation about the boat desk is useful. In watersports (e.g., water skiing, wakeboarding, etc.), a tower can be used to anchor a towline at a high elevation about the boat deck, thereby increasing the user's ability to be lifted higher into the air. Conventional towers further include a sunshade system for protection from the sun, and provide a mounting structure for additional equipment (e.g., navigation equipment, communication equipment, speakers, fishing rods, lighting, etc.).

U.S. Pat. No. 11,046,397 discloses a telescoping tower for a boat that is secured to a hull of a watercraft as an add-on accessory (e.g., a bolt-on design). However, conventional bolt-on telescoping towers are bulky and the entire mechanism is external to the hull, which disrupts aesthetic lines of the boat's design, among other things. For example, with a given tower support size, the outer static structure that the tower support telescopes into must be significantly larger than the tower support itself.

Furthermore, conventional bolt-on towers negatively affect a watercraft's center of gravity and handling since conventional bolt-on towers position all the weight (e.g., actuators, sliding structures, etc.) about the top edge of the hull (e.g., gunnel), which raises the center of gravity.

SUMMARY

The disclosure provides, in one aspect, a watercraft including a hull, a roof, a support including a first end coupled to the roof and a second end positioned within the hull, and an actuation assembly coupled to the support. The support is moveable between a first position and a second position in response to activation of the actuation assembly. The support extends into the hull a first distance in the first position and a second distance in the second position. The second distance is larger than the first distance.

In some embodiments, the actuation assembly includes a base coupled to the hull, an extension member movable with respect to the base, and a bracket coupled to the extension member and coupled to the support.

In some embodiments, the support includes a first rail, a second rail, a first side plate positioned between the first rail and the second rail, and a second side plate positioned between the first rail and the second rail.

In some embodiments, a cavity is at least partially formed by the first rail, the second rail, the first side plate, and the second side plate. The actuation assembly is at least partially positioned within the cavity.

In some embodiments, the watercraft further includes a windshield coupled to the hull. The roof abuts the windshield when the support is in the second position.

In some embodiments, the support is movable to a third position between the first position and the second position.

In some embodiments, the support extends through an aperture in a top edge surface of the hull.

In some embodiments, the support extends from the hull at an angle with the support in the first position and the second position.

In some embodiments, the watercraft further includes a brace assembly positioned within the hull and coupled to the support.

In some embodiments, the brace assembly includes a bearing positioned at least partially within a groove formed in the support.

In some embodiments, the brace assembly further includes a block and a bracket, wherein the bearing is coupled to the block; and wherein the block is coupled to and movable with respect to the bracket.

In some embodiments, the block is movable with respect to the bracket along an axis orthogonal to the support.

In some embodiments, the brace assembly further includes an eccentric pin coupled between the block and the bracket, and the block moves along the axis in response to rotation of the eccentric pin.

In some embodiments, the brace assembly is one of a plurality of brace assemblies positioned within the hull and coupled to the support. At least one of the plurality of brace assemblies is positioned along a first edge of the support; and at least one of the plurality of brace assemblies is positioned along a second edge of the support.

In some embodiments, the support is a first support and the watercraft further includes a second support coupled to the roof; and the actuation assembly is a first actuation assembly, and the watercraft further includes a second actuation assembly coupled to the second support.

In some embodiments, the watercraft further includes a user interface configured to receive a user input; and wherein the position of the roof with respect to the hull is adjusted in response to receiving the user input.

The disclosure provides, in one aspect, a watercraft including a hull, a windshield coupled to the hull, a roof, a support coupled to the roof, and an actuation assembly coupled to the support. The support is moveable between a first position and a second position in response to activation of the actuation assembly. The roof abuts the windshield when the support is in the second position such that a cabin is at least partially defined by the roof and the windshield.

In some embodiments, the support includes an end positioned within the hull, and wherein the support extends into the hull a first distance in the first position and a second distance in the second position. The second distance is larger than the first distance.

The disclosure provides, in one aspect, a tower assembly including a roof, a support including a first end coupled to the roof and a second end opposite the first end, and an actuation assembly coupled to the support and positioned at least partially within the support. The actuation assembly extends from the second end of the support.

In some embodiments, the second end defines an aperture and the actuation assembly extends through the aperture.

The disclosure provides, in one aspect, an assembly including, a block including a base and an arm, the base and the arm at least partially define a receiving area, an eccentric pin positioned within the receiving area, and a bearing coupled to the base of the block.

In some embodiments, the bearing position is adjustable in at least 3 degrees of freedom.

In some embodiments, the bearing position is adjustable in at least 4 degrees of freedom.

In some embodiments, an end of the arm is releasably clamped to the base by a fastener.

In some embodiments, the eccentric pin is rotatable within the receiving area when the arm is unclamped from the base.

In some embodiments, the base includes a planar surface that abuts the bearing.

In some embodiments, the base includes a boss extending from the planar surface, and wherein the bearing is rotatable about the boss.

In some embodiments, a fastener couples the bearing to the boss.

In some embodiments, the eccentric pin includes a barrel portion that abuts the arm and the base.

In some embodiments, the arm is adjustably positioned along the barrel portion.

In some embodiments, the eccentric pin further includes a cylinder portion extending from an end of the barrel portion, and the cylinder axis of the cylinder portion is spaced from a central axis of the barrel portion.

In some embodiments, the eccentric pin includes a hex portion extending from the cylinder portion.

In some embodiments, the hex portion includes a detent.

In some embodiments, the assembly further includes a bracket having an aperture, the cylinder portion is at least partially positioned within the aperture.

In some embodiments, a first end of the eccentric pin is supported by the bracket, and a second end of the eccentric pin is supported by a hull panel.

In some embodiments, the assembly further includes a fastener positioned between the eccentric pin and the hull panel.

In some embodiments, the bracket is secured to the hull panel with a bracket fastener.

In some embodiments, the bearing includes an arcuate surface.

In some embodiments, the arcuate surface is cylindrical.

In some embodiments, the assembly further includes a support including a groove, the bearing is at least partially positioned within the groove.

The disclosure provides, in one aspect, a support including, an extrusion including, a first rail, a second rail, a first side plate positioned between the first rail and the second rail, and a second side plate positioned between the first rail and the second rail, a cavity is at least partially formed by the first rail, the second rail, the first side plate, and the second side plate, a first mounting flange extending into the cavity from the first rail, and a second mounting flange extending into the cavity from the second rail.

In some embodiments, the extrusion includes a first thickness at the first side plate and a second thickness at a transition between the first side plate and the first rail, the second thickness is larger than the first thickness.

In some embodiments, the support is symmetrical about an axis, the axis is orthogonal to the first side plate and the second side plate.

In some embodiments, the support further includes an access aperture formed in the first side plate, and a cover positioned at least partially within the access aperture.

In some embodiments, the support further includes an actuator aperture formed in at least the first side plate, and a cover positioned at least partially within the actuator aperture.

In some embodiments, the cover includes an expanded region that extends from the first side plate.

The disclosure provides, in one aspect, a method of controlling a tower assembly for a watercraft, the method including, determining a target tower height of the tower assembly, determining a target actuator height based on the target tower height, detecting a first position of a first actuator coupled to a first support of the tower assembly, detecting a second position of a second actuator coupled to a second support of the tower assembly, determining a first difference between the target actuator height and the first position, determining a second difference between the target actuator height and the second position, comparing the first difference with the second difference to determine which one of the first actuator and the second actuator is a behind actuator and which one is an ahead actuator, activating the behind actuator at a first speed, and activating the ahead actuator at a second speed slower than the first speed.

In some embodiments, determining the target tower height includes receiving a user input on a touchscreen of the watercraft.

In some embodiments, determining the target tower height includes receiving a selection of a saved position.

In some embodiments, determining the target tower height includes receiving a user input on a user device spaced from the watercraft.

In some embodiments, detecting the first position of the first actuator includes receiving a signal from a first position sensor positioned within the first actuator.

In some embodiments, the first actuator is positioned within the first support.

In some embodiments, the first support and the second support are at least partially positioned within a hull of the watercraft.

In some embodiments, the first speed is a maximum speed.

In some embodiments, the second speed is proportional to a difference between the first position and the second position.

In some embodiments, the method further includes detecting a load on a load sensor and deenergizing the first actuator and the second actuator if the load is above a threshold.

Other aspects of the disclosure will become apparent by consideration of the detailed description and accompanying drawings.

BRIEF DESCRIPTION OF THE DRAWINGS

These and other features, aspects, and advantages of the present technology will become better understood with regards to the following drawings. The accompanying figures and examples are provided by way of illustration and not by way of limitation.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "coupled," as used herein, is defined as "connected," although not necessarily directly, and not necessarily mechanically. The term coupled is to be understood to mean physically, magnetically, chemically, fluidly, electrically, or otherwise coupled, connected or linked and does not exclude the presence of intermediate elements between the coupled elements absent specific contrary language.

Figure 3A:
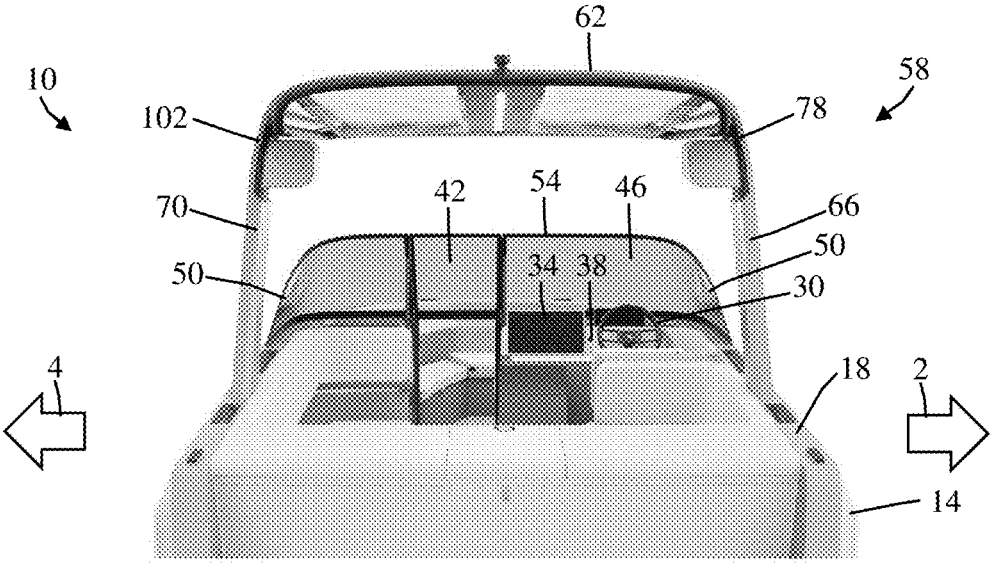
FIG. 3A is a rear view of a watercraft with an adjustable tower assembly in a raised position.

To facilitate the understanding of this disclosure, a number of marine terms are defined below. Terms defined herein have meanings as commonly understood by a person of ordinary skill in the areas relevant to the present disclosure. "Starboard" refers to the right-hand, or driver's, side of the watercraft. "Port" refers to the left-hand, or passenger's, side of the watercraft. "Bow" refers to the front of the watercraft. "Transom" and "stern" refer to the rear of the watercraft. The starboard 2, port 4, bow 6, and stem 8 directions are illustrated in FIGS. 1 and 3A for reference.

Figure 1:
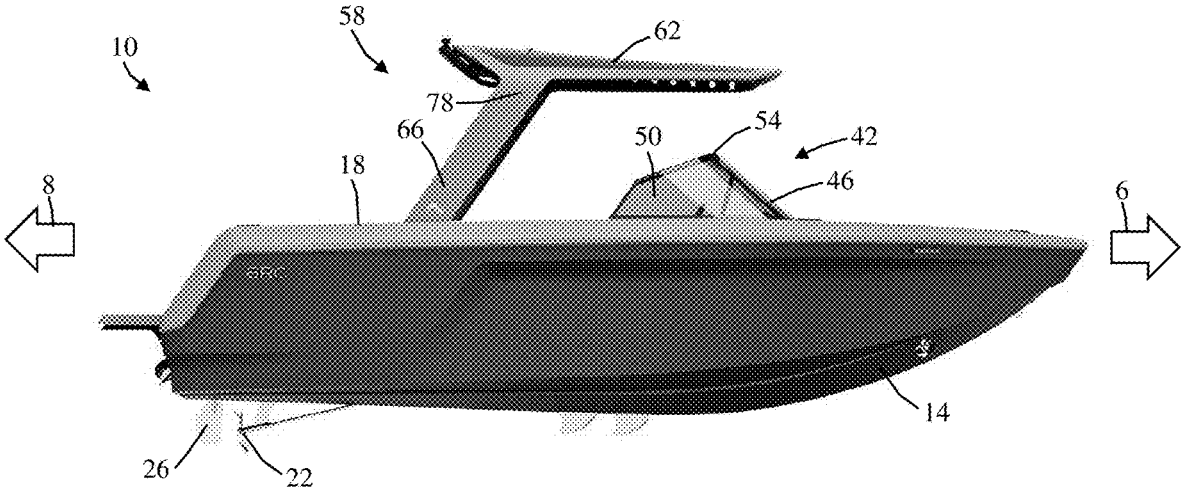
FIG. 1 is a side view of a watercraft with an adjustable tower assembly in a raised position.

With reference to FIG. 1, a watercraft 10 includes a hull 14 that defines a top edge surface 18 commonly referred to as the gunwale or gunnel. In some embodiments, the watercraft 10 is propelled through the water by a propeller 22 that is rotationally driven by an electric drive. In some embodiments, the electric drive includes an electric motor (e.g., an induction motor, a synchronous motor, a brushless DC motor, a permanent magnet rotor, an interior permanent magnet motor, a surface permanent magnet motor, a reluctance motor, etc.) and a power converter (e.g., an inverter, a converter, etc.). In some embodiments, the watercraft 10 includes a battery electrically coupled to the electric drive. The watercraft 10 is steered through the water with adjustment of a rudder 26, for example, by an operator input 30 (e.g., steering wheel). In the illustrated embodiment, the watercraft 10 includes a user interface 34 (e.g., a touch screen display) positioned on a front dash 38 and configured to receive a user input (e.g., desired tower height). In some embodiments, the user interface is a mobile device (e.g., a cell phone, a tablet, etc.) separate from or removable from the watercraft.

In the illustrated embodiment, the watercraft 10 includes a windshield 42 coupled to the hull 14. The windshield 42 includes a front portion 46 that is bow-facing and side portions 50 that are starboard-facing and port-facing. In the illustrated embodiment, the front portion 46 of the windshield 42 defines a top edge 54.

Figure 2:
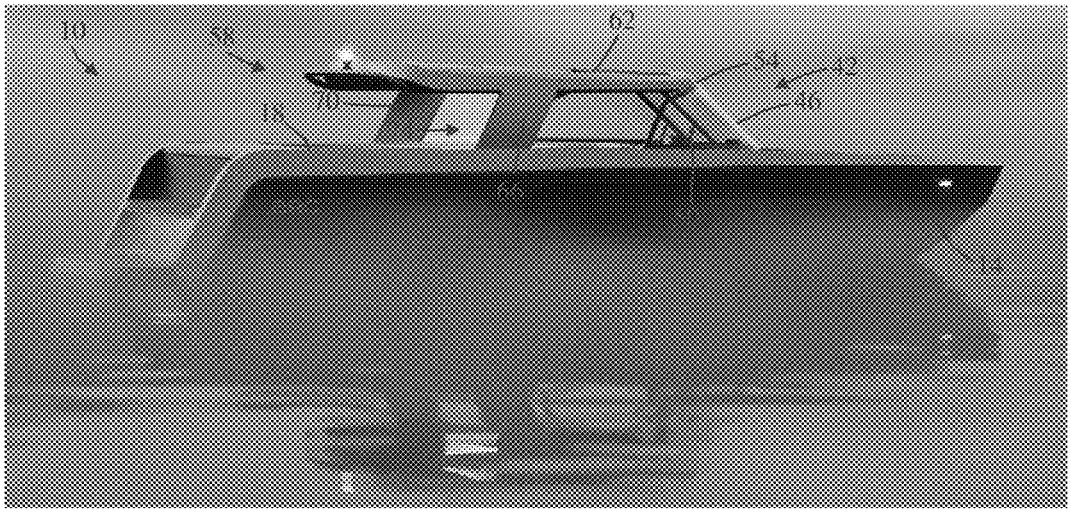
FIG. 2 is a side view of the watercraft of FIG. 1, with the adjustable tower assembly in a lowered position.

With reference to FIGS. 1 and 2, the watercraft 10 includes an adjustable tower assembly 58. The adjustable tower assembly 58 includes a roof 62, a first support 66 coupled to the roof 62, and a second support 70 coupled to the roof 62. As detailed further herein, the adjustable tower assembly 58 is movable between a raised position (FIG. 1) and a lowered position (FIG. 2). In the lowered position (FIG. 2), the adjustable tower assembly 58 creates a partially enclosed cabin 74. In some embodiments, the adjustable tower assembly 58 in the lowered position abuts the windshield 42 to create the partially enclosed cabin 74. In some embodiments, the roof 62 abuts the top edge 54 of the windshield 42 to create the partially enclosed cabin 74. In other words, the roof 62 abuts the windshield 42 when the first support 66 is in the retracted position such that the cabin 74 is at least partially defined by the roof 62 and the windshield 42. In other embodiments, the roof 62 is positioned adjacent to but spaced from the windshield 42 (e.g., at least a portion of the roof 62 is no more than 4 inches away from the windshield 42) to create the partially enclosed cabin (FIG. 4B). The cabin 74 advantageously provides protection from weather (e.g., rain, wind, sun, etc.) for the occupants of the watercraft 10.

Figure 3B:
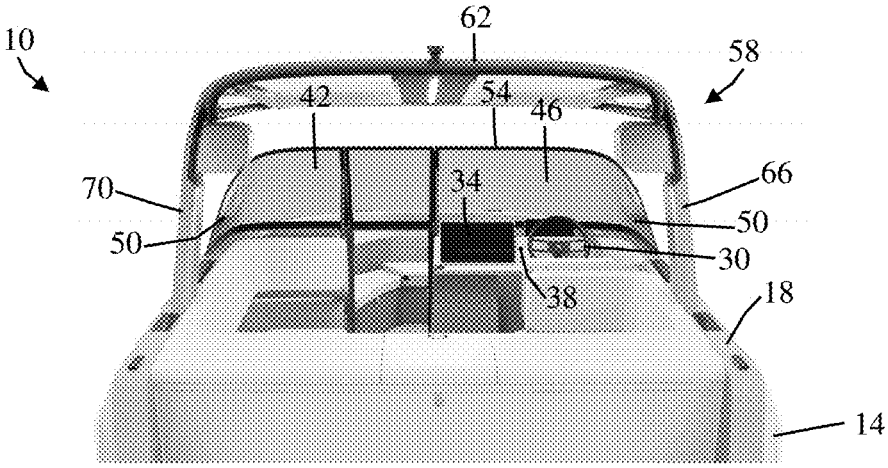
FIG. 3B is a rear view of a watercraft with an adjustable tower assembly in an intermediate position.
Figure 3C:
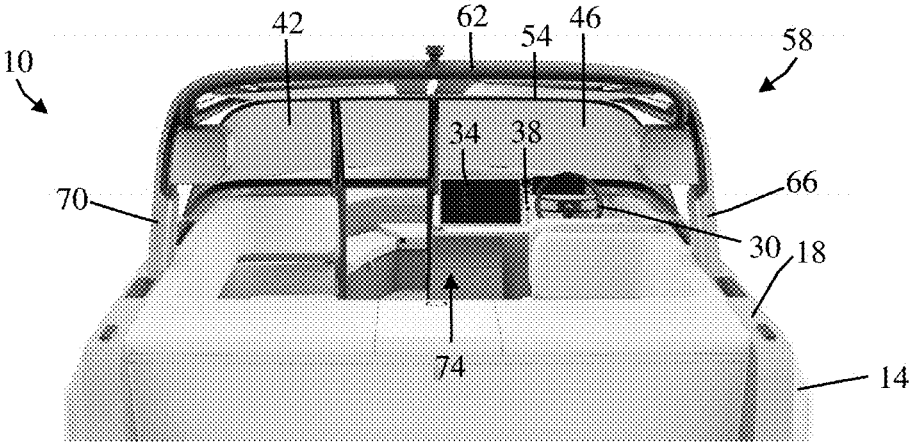
FIG. 3C is a rear view of a watercraft with an adjustable tower assembly in a lowered position.

With reference to FIGS. 3A, 3B, and 3C, in some embodiments, the adjustable tower assembly 58 is movable between at least a raised position (FIG. 3A), an intermediate position (FIG. 3B), and a lowered position (FIG. 3C). In the illustrated embodiment, the intermediate position (FIG. 3B) is between the raised position (FIG. 3A) and the lowered position (FIG. 3C). In some embodiments, the adjustable tower assembly 58 is movable to any number of intermediate positions between a fully raised position and a fully lowered position.

Figure 4A:
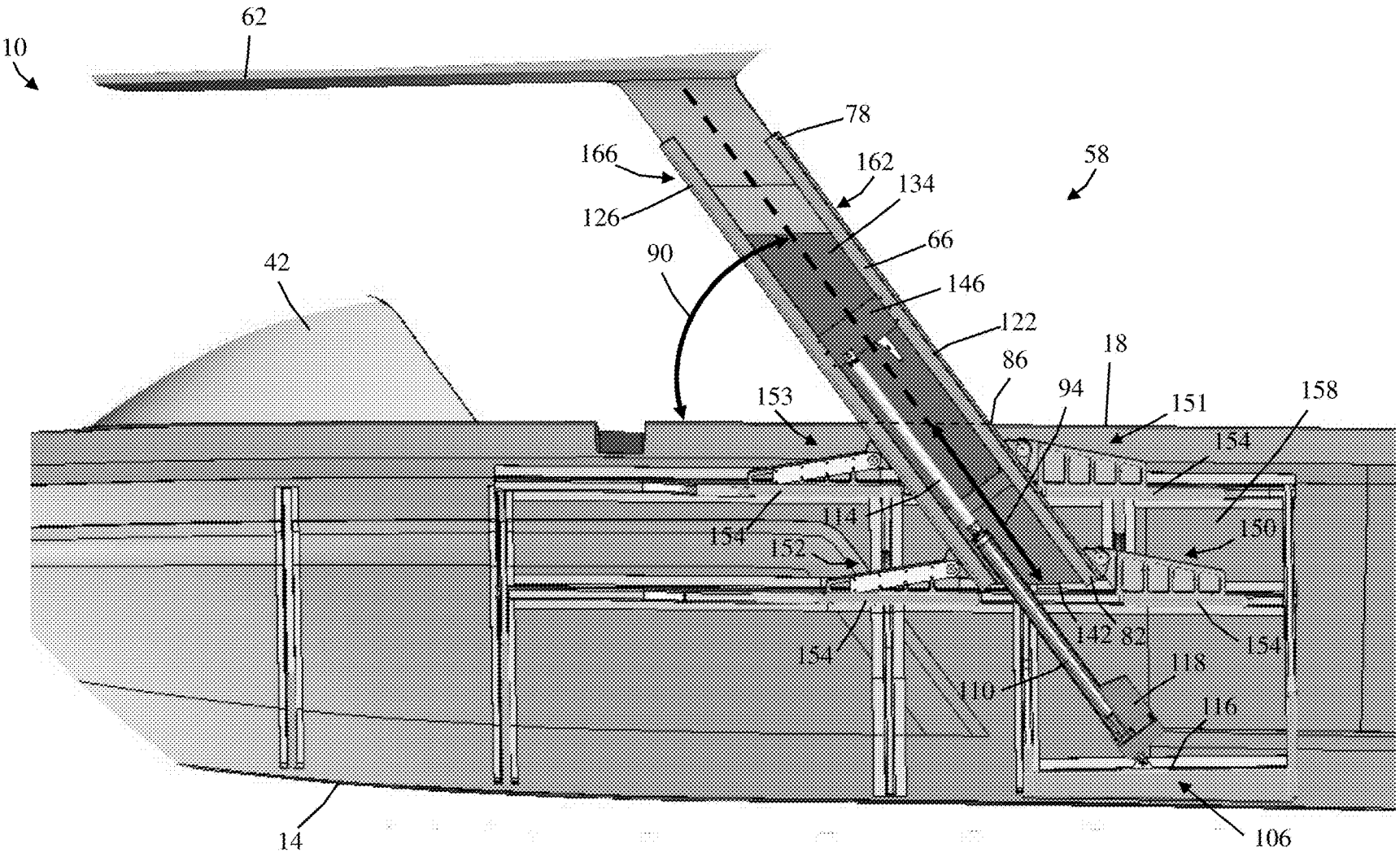
FIG. 4A is a side cross-sectional view of an adjustable tower assembly in a raised position.
Figure 4B:
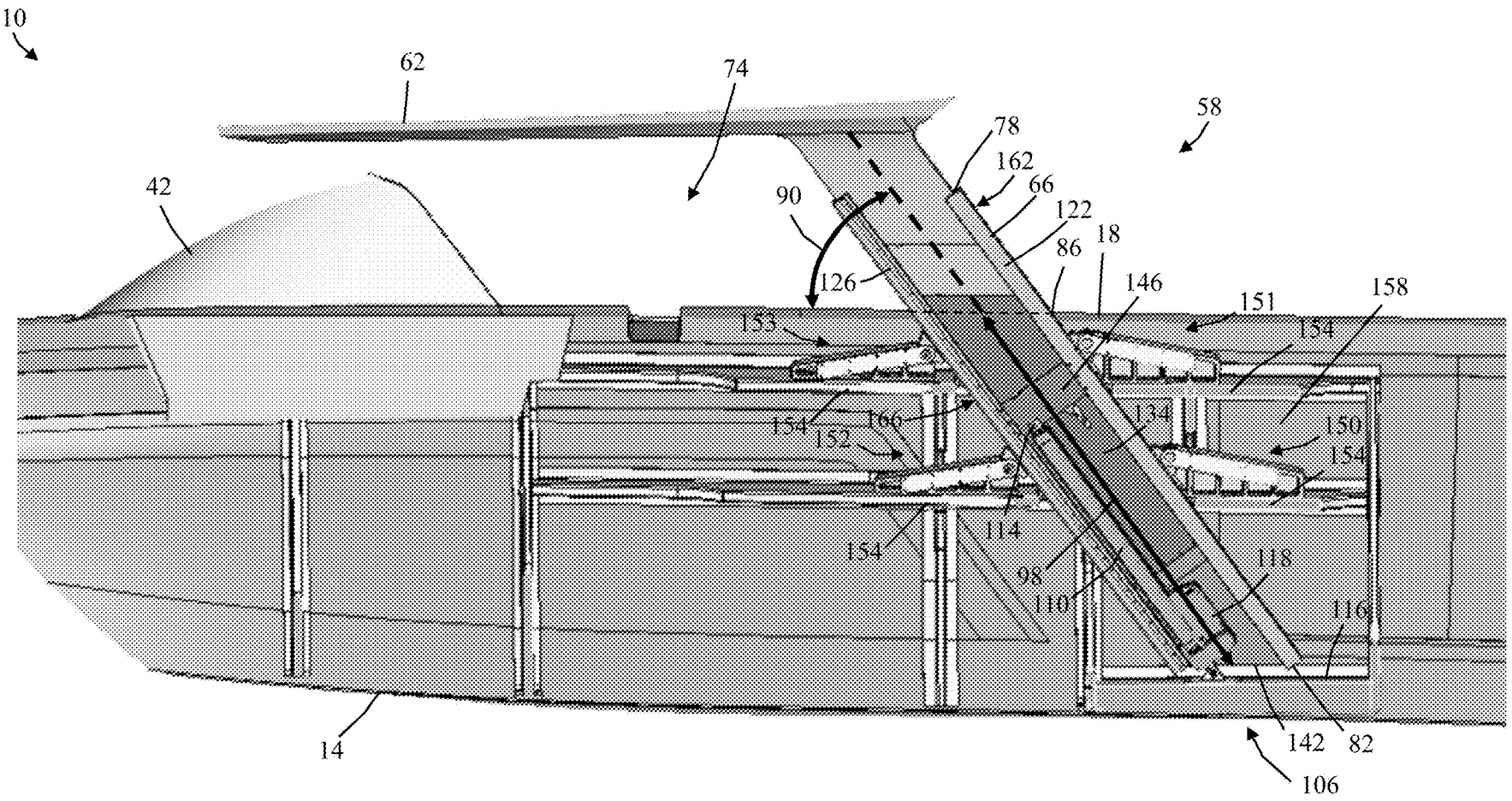
FIG. 4B is a side cross-sectional view of the adjustable tower assembly of FIG. 4A in a lowered position.

With reference to FIGS. 4A and 4B, the first support 66 includes a first end 78 coupled to the roof 62 and a second end 82 opposite the first end 78 positioned within the hull 14. In the illustrated embodiment, the first support 66 extends through an aperture 86 formed in the top edge surface 18 of the hull 14. The first support 66 extends from the hull 14 at an angle 90 with respect to the top edge surface 18 when the first support 66 is in the raised and lowered positions. In other words, the angle 90 the first support 66 extends from the hull 14 remains constant as the adjustable tower assembly 58 is moved between positions.

In the illustrated embodiment, the first support 66 extends into the hull 14 a first distance 94 in a raised position (FIG. 4A) and a second distance 98 in a lowered position (FIG. 4B). In the illustrated embodiment, the second distance 98 is larger than the first distance 94. In other words, the first support 66 retracts within the hull 14 when moving toward the lowered position (FIG. 4B). In the illustrated embodiment, the first distance 94 and the second distance 98 are measured along the first support 66 from the top edge surface 18 to the second end 82.

Likewise, the second support 70 includes a first end 102 coupled to the roof 62 and a second end opposite the first end 102 positioned within the hull 14. In other words, the first support 66 and the second support 70 extend into the hull 14. In some embodiments, the second support 70 is substantially similar or identical to the first support 66. As such, description herein of the first support 66 applies equally to the second support 70, and the term "support" used herein may refer to either the first support 66 or the second support 70.

Unlike conventional tower assemblies that simply attach to an exterior of the hull, the adjustable tower assembly 58 disclosed herein advantageously retracts within the hull 14 and is integrated with the hull 14. In the illustrated embodiment, portions of the adjustable tower assembly 58 retract through and extends below the starboard and port top edge surface 18 of the hull 14. As such, the adjustable tower assembly 58 is smaller than conventional telescoping tower assemblies that retract within themselves and are simply attached to a watercraft.

Figure 5A:
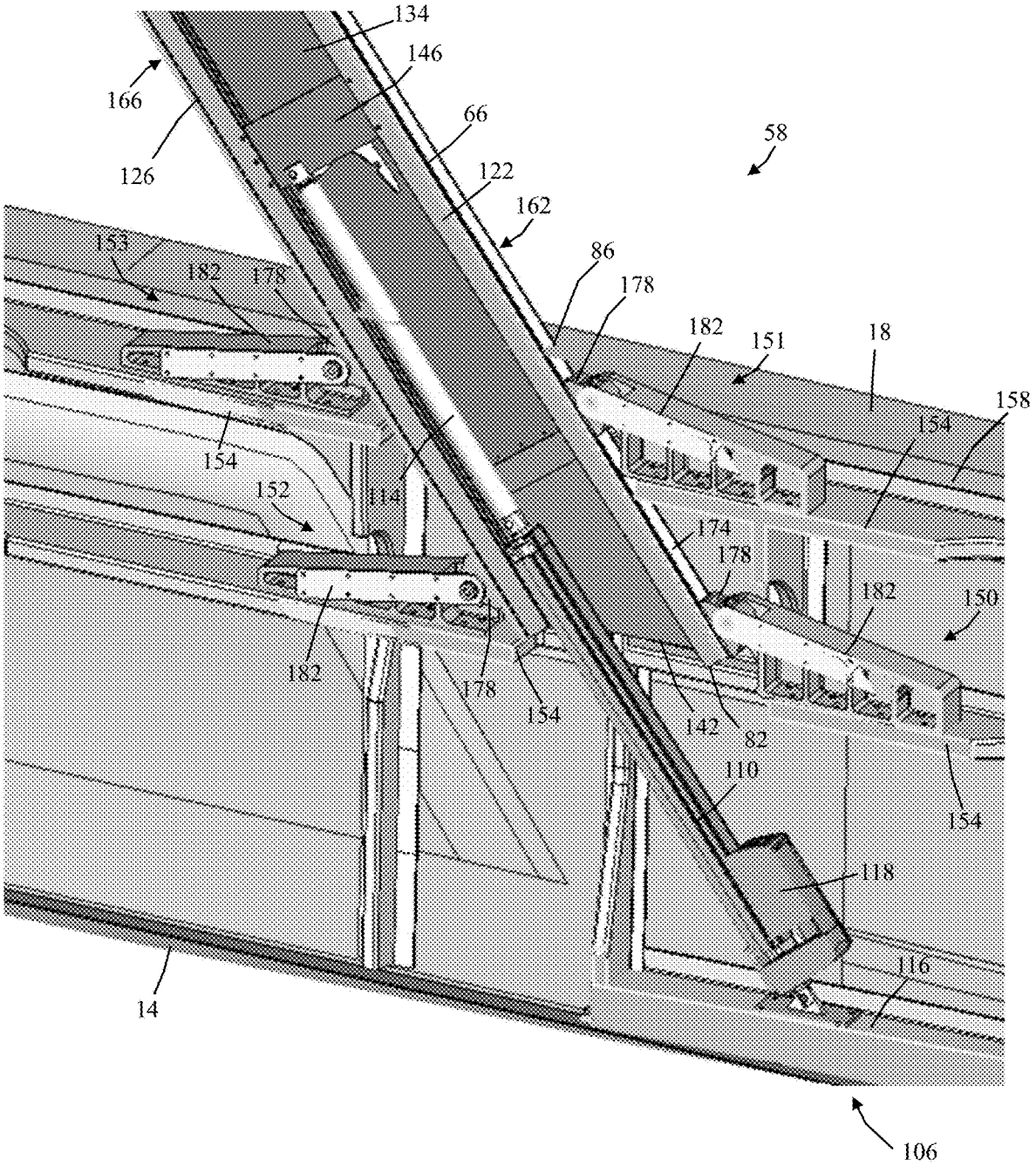
FIG. 5A is a partial perspective cross-sectional view of an adjustable tower assembly in a raised position.
Figure 5B:
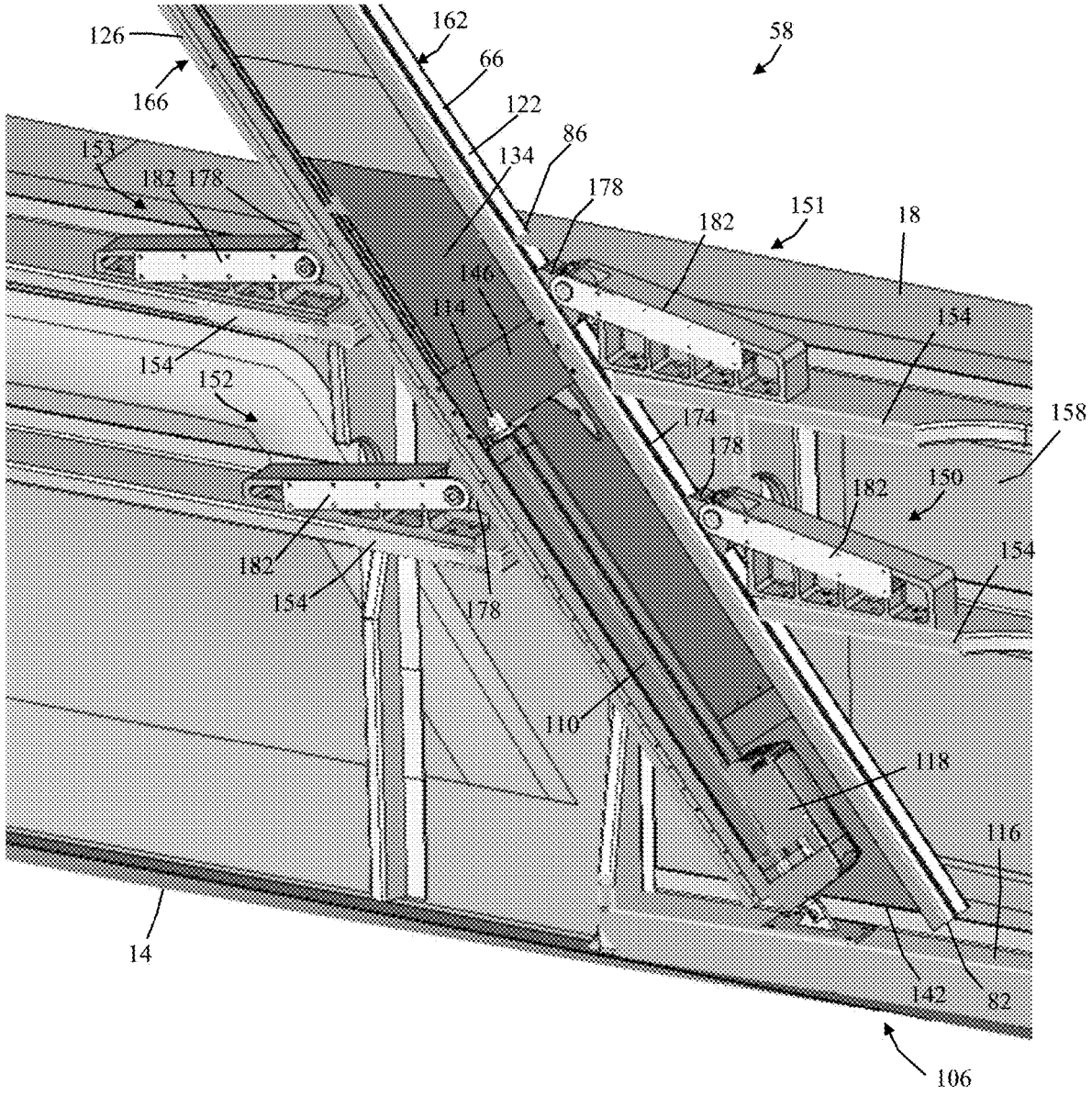
FIG. 5B is a partial perspective cross-sectional view of an adjustable tower assembly in a lowered position.

With reference to FIGS. 5A and 5B, the adjustable tower assembly 58 includes an actuation assembly 106 coupled to the first support 66. As detailed further herein, the actuation assembly 106 is configured to move the first support 66 and the roof 62 between a plurality of positions. In the illustrated embodiment, the first support 66 is movable between a raised position (FIG. 5A) and a lowered position (FIG. 5B) in response to activation of the actuation assembly 106. In some embodiments, the actuation assembly 106 is activated in response to receiving a user input at the user interface 34. As such, the position of the roof 62 with respect to the hull 14 is adjusted in response to receiving the user input at the user interface 34. In other words, the height of the roof 62 is user-selected. In some embodiments, the user interface 34 is configured to allow users to save a favorite certain roof heights or positions.

In some embodiments, the actuation assembly 106 is a first actuation assembly and the adjustable tower assembly further includes a second actuation assembly, similar to the first actuation assembly 106, coupled to the second support 70. In some embodiments, the second actuation assembly is substantially similar or identical to the first actuation assembly 106. As such, description herein of the first actuation assembly 106 applies equally to the second actuation assembly, and the term "actuation assembly" used herein may refer to either the first actuation assembly 106 or the second assembly. In other embodiments, a single actuation assembly is coupled to one or more of the supports.

With continued reference to FIG. 5A, the actuation assembly 106 includes a base 110 coupled to the hull 14 and an extension member 114 movable with respect to the base 110. In the illustrated embodiment, the base 110 is secured directly to an internal surface 116 of the hull 14 with fasteners. In some embodiments, the actuation assembly 106 is a linear actuator. In some embodiments, the actuation assembly 106 is electrically powered, hydraulically powered, or pneumatically powered. In the illustrated embodiment, the base 110 includes an electrical motor 118, and the extension member 114 extends and retracts with respect to the base 110 in response to activation of the electric motor 118.

Figure 6:
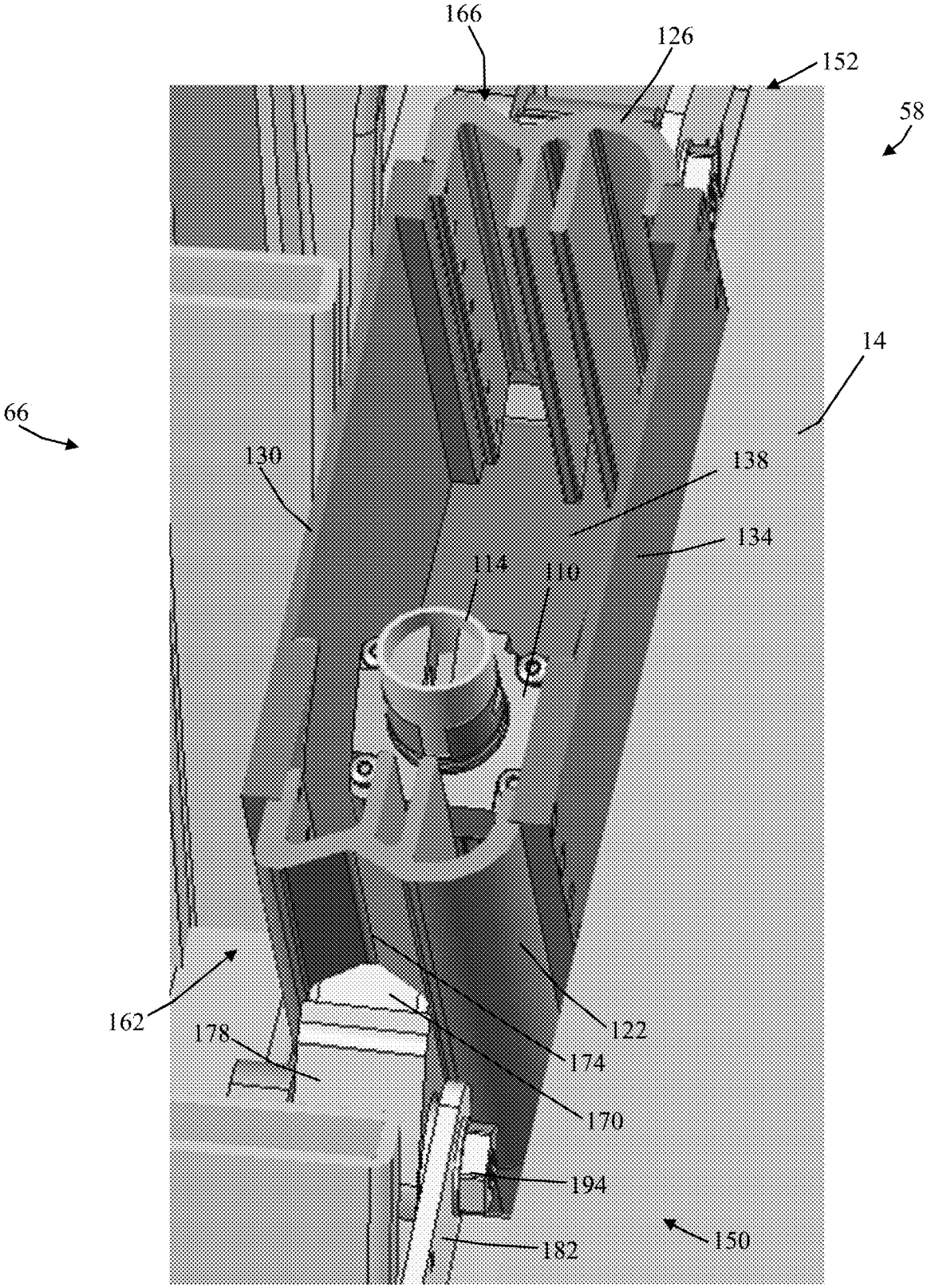
FIG. 6 is a cross-sectional view of a support of an adjustable tower assembly.

With reference to FIG. 6, in some embodiments, the first support 66 includes a first rail 122, a second rail 126, a first side plate 130 positioned between the first rail 122 and the second rail 126, and a second side plate 134 positioned between the first rail 122 and the second rail 126. In the illustrated embodiment, the first rail 122 is spaced apart and parallel to the second rail 126. In some embodiments, the first rail 122 and the second rail 126 are extruded metal. In the illustrated embodiment, the first side plate 130 is spaced apart and parallel to the second side plate 134. In the illustrated embodiment, a cavity 138 is at least partially formed by the first rail 122, the second rail 126, the first side plate 130, and the second side plate 134. In some embodiments, the actuation assembly 106 is at least partially positioned within the cavity 138 of the first support 66. In other words, the actuation assembly 106 is coupled to the support 66 and is positioned at least partially within the support 66.

With reference to FIGS. 5A and 5B, the actuation assembly 106 extends from the second end 82 of the support 66. The second end 82 defines an aperture 142 and the actuation assembly 106 extends through the aperture 142. The actuation assembly 106 further includes a bracket 146 coupled to the extension member 114 and coupled to the first support 66. In other words, the bracket 146 connects the extension member 114 to the first support 66. In the illustrated embodiment, the bracket 146 is secured to the first rail 122 and the second rail 126 with fasteners.

With continued reference to FIGS. 5A and 5B, the watercraft 10 further includes a plurality of brace assemblies 150, 151, 152, 153 (a.k.a. hardpoints) positioned within the hull 14 and coupled to the first support 66. Each of the brace assemblies 150-153 is positioned on a shelf 154 extending from an interior surface 158 of the hull 14. The brace assemblies 150 and 151 are positioned along a first edge 162 of the support 66 (e.g., along the first rail 122) and the brace assemblies 152, 153 are positioned along a second edge 166 of the support 66 (e.g., along the second rail 126), opposite the first edge 162. In other words, at least one brace assembly is positioned along the first edge 162 of the support 66, and at least one brace assembly is positioned along the second edge 166 of the support 66. In some embodiments, the watercraft 10 includes at least one brace assembly positioned within the hull 14 and coupled to the support 66. In some embodiments, the brace assemblies 151, 152, 153 are similar or identical to the brace assembly 150. As such, description herein of the brace assembly 150 applies equally to the brace assemblies 151, 152, 153, and the term "brace assembly" used herein may refer to any of brace assemblies 150-153.

Figure 7:
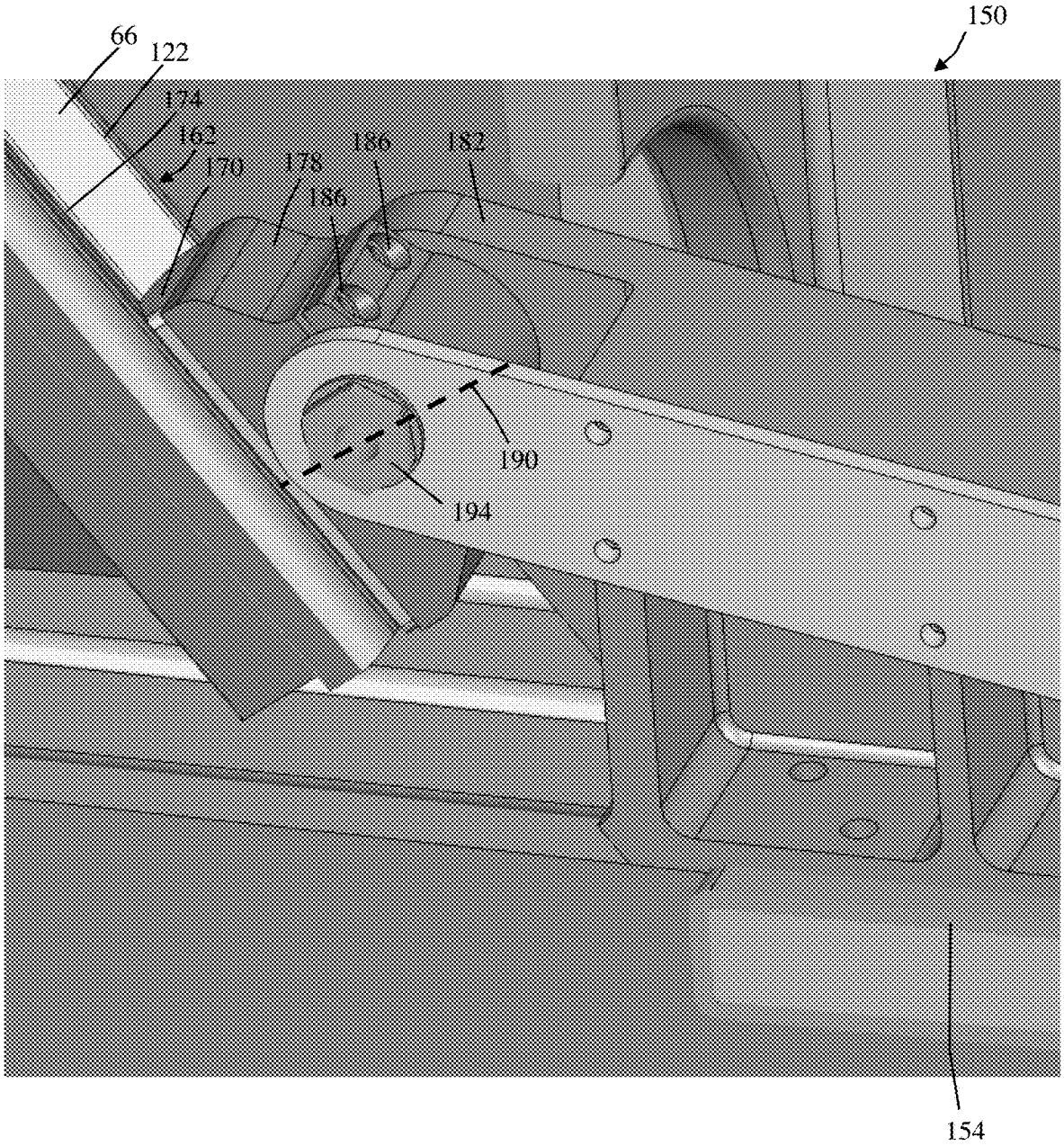
FIG. 7 is a partial perspective view of a brace assembly.

With reference to FIG. 7, the brace assembly 150 includes a bearing 170 positioned at least partially within a groove 174 formed in the support 66. The bearing 170 is slidable along the groove 174. In some embodiments, the bearing 170 is made of a polymer. The brace assembly 150 further includes a block 178 and a bracket 182. In the illustrated embodiment, the bearing 170 is coupled to the block 178. In some embodiments, the block 178 is a bearing carrier with pinch bolts received in apertures 186.

Figure 8:
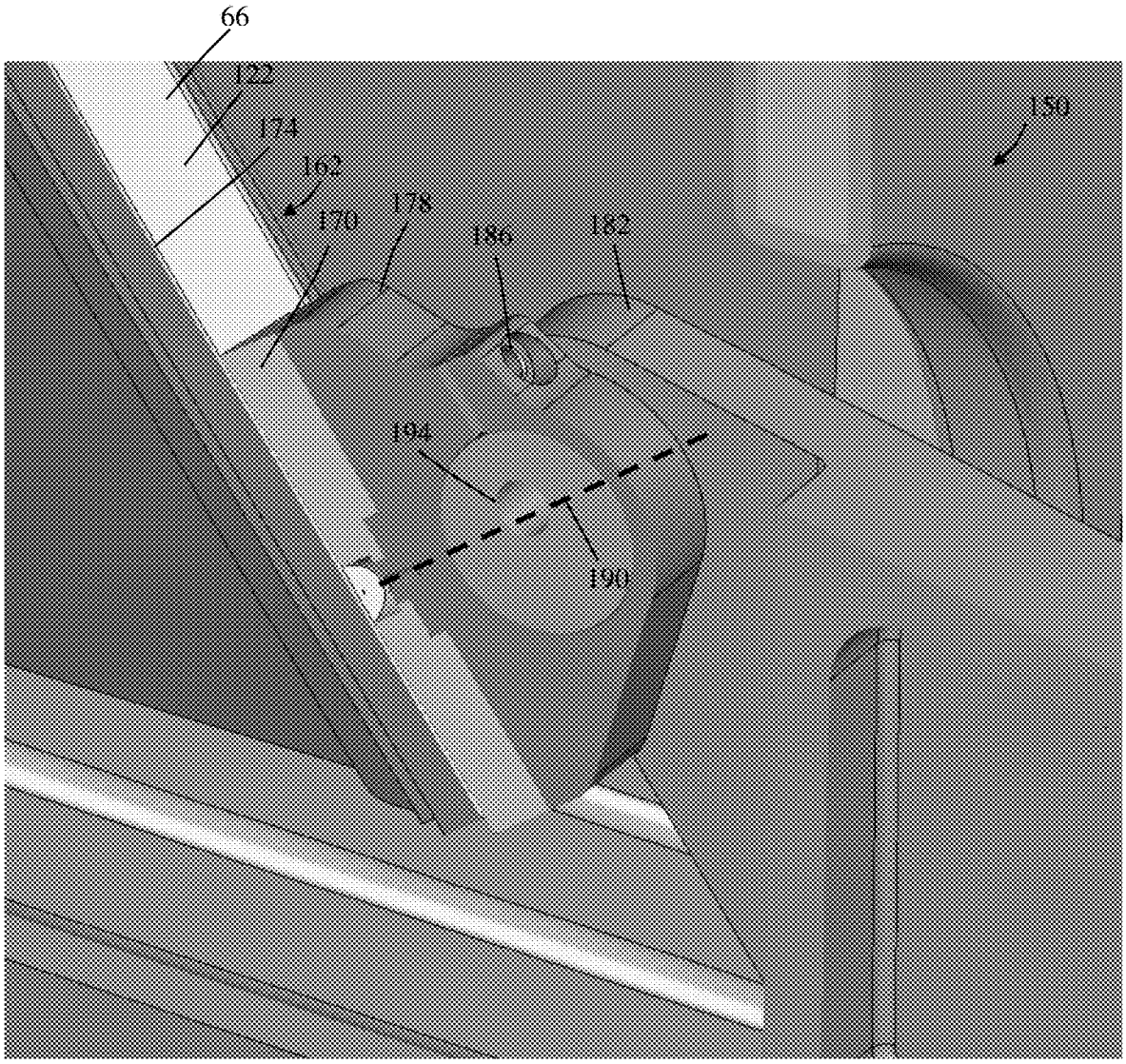
FIG. 8 is a cross-sectional view of the brace assembly of FIG. 7.

With reference to FIG. 8, the block 178 is coupled to and movable with respect to the bracket 182. In some embodiments, the block 178 is movable with respect to the bracket 182 along an axis 190 that is orthogonal to the support 66. In the illustrated embodiment, the axis 190 is orthogonal to the first rail 122. The brace assembly 150 includes an eccentric pin 194 coupled between the block 178 and the bracket 182. The block 178 moves along the axis 190 in response to rotation of the eccentric pin 194. Advantageously, the position of the block 178 and bearing 170 is adjustable relative to the groove 174 of the support 66 in response to rotation of the eccentric pin 194.

In the illustrated embodiment, the watercraft 10 is a boat. In other embodiments, the watercraft is a fishing boat, a dingy boat, a deck boat, a bowrider boat, a catamaran boat, a cuddy cabin boat, a center console boat, a houseboat, a trawler boat, a cruiser boat, a game boat, a yacht, a personal watercraft, a water scooter, a jet-ski, a runabout boat, a jet boat, a wakeboard boat, a wake boat, a ski boat, a life boat, a pontoon boat, or any suitable motor boat, vessel, craft, or ship. Although examples are illustrated with respect to an all-electric watercraft, the adjustable tower assembly described herein can also be used in a conventional motorboat application (e.g., with a gasoline or diesel-powered engine).

Figure 9:
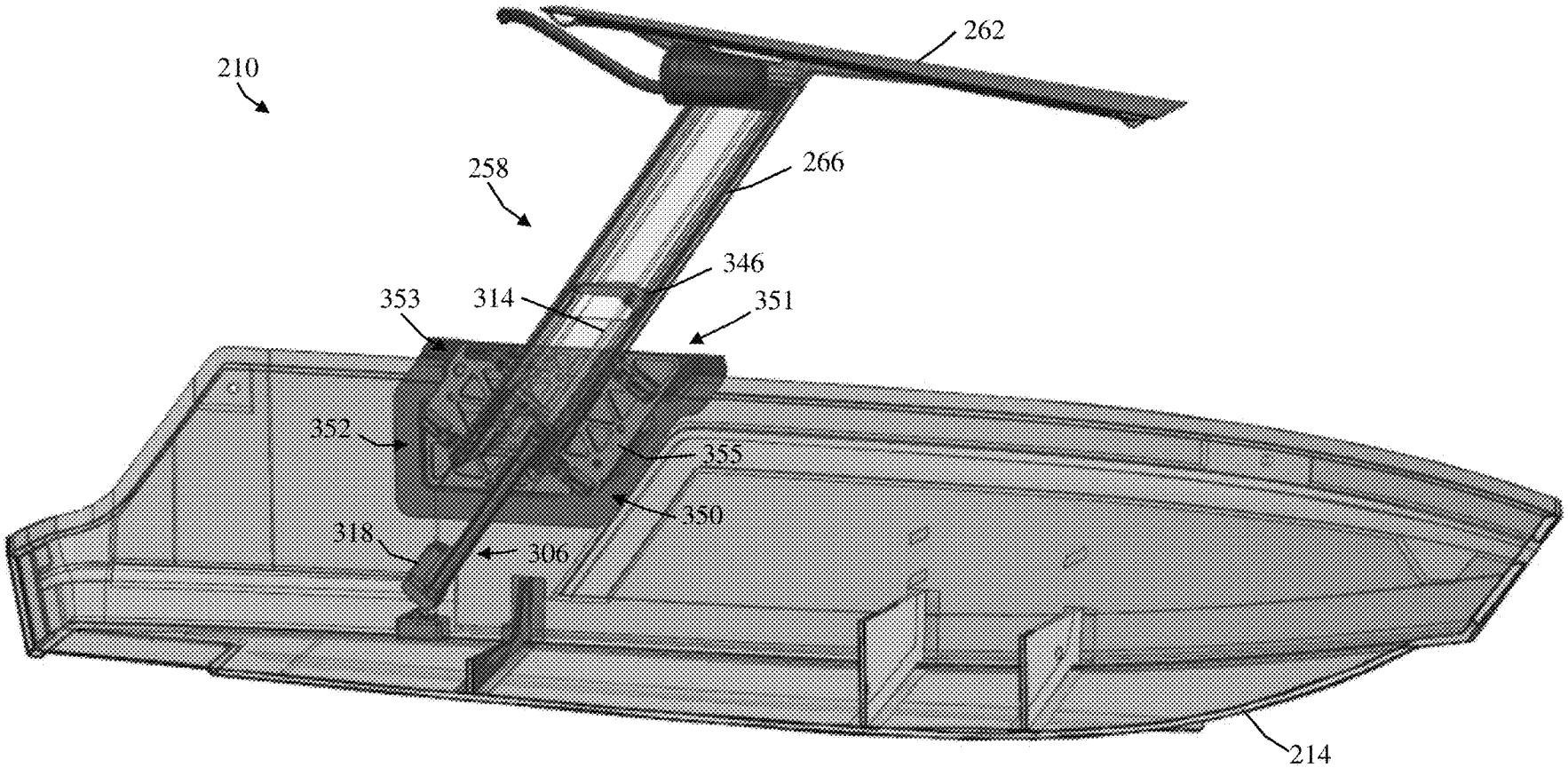
FIG. 9 is a cross-sectional view of a watercraft with an adjustable tower assembly in a raised position.

With reference to FIG. 9, a watercraft 210, including a hull 214, a roof 262, an adjustable tower assembly 258, and plurality of brace assemblies 350, 351, 352, 353 is shown. The tower assembly 258 is shown in a raised position with the extension member 314 of the actuation assembly 306 fully extended. Similar to other embodiments disclosed herein, the watercraft includes a plurality of brace assemblies 350, 351, 352, 353 positioned with the hull 214 and coupled to a first support 266 (of two on either side of the watercraft 210). Each of the brace assemblies 350, 351, 352, 353 are coupled to a hull panel 355, which is in turn coupled to the hull 214 of the watercraft 210. As discussed herein, the brace assemblies 350, 351, 352, 353 are configured to provide six degrees of freedom or adjustability to insure the assemblies properly interface with the support 266.

Figure 10A:
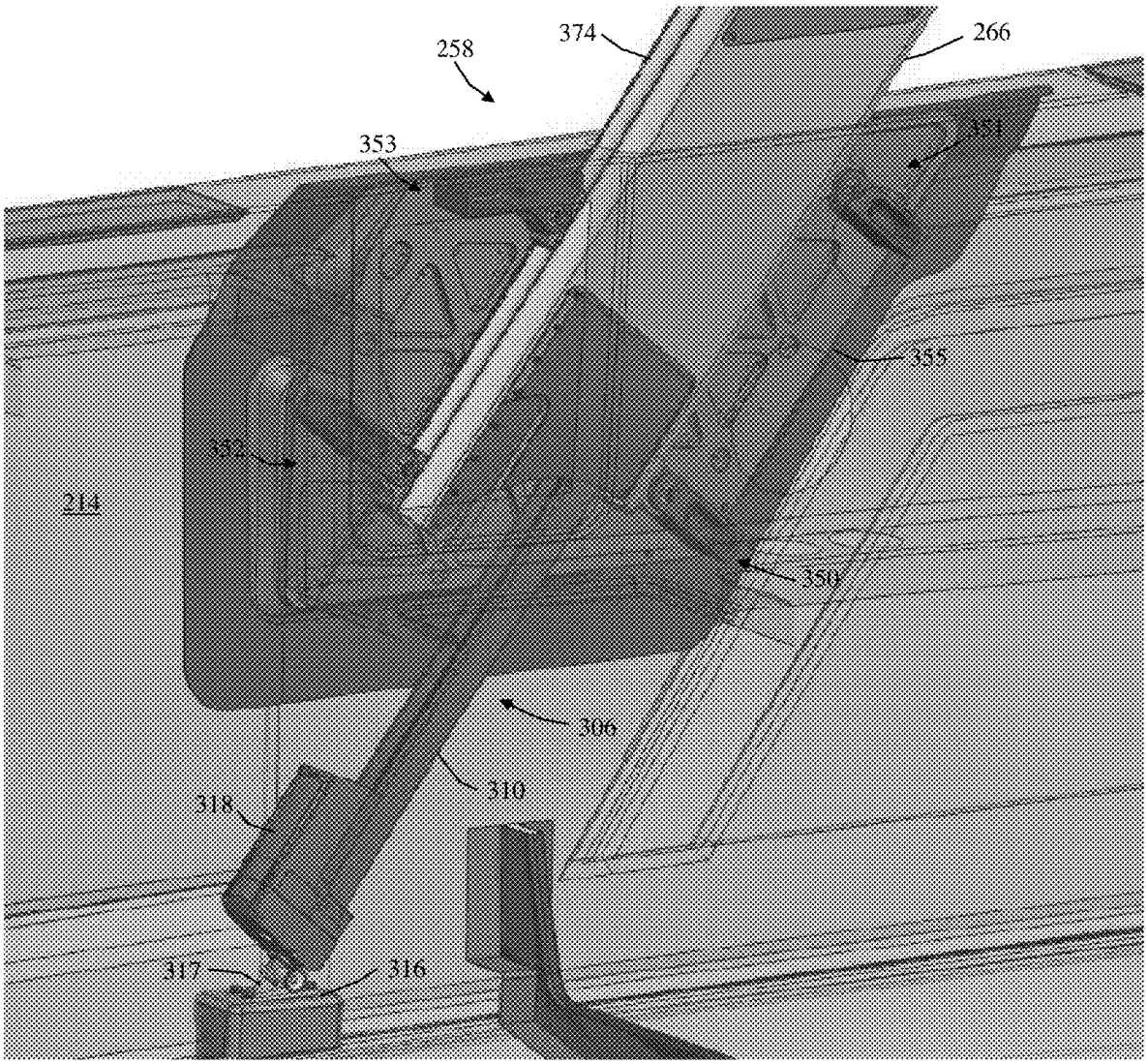
FIG. 10A is a partial perspective view of the adjustable tower assembly of FIG. 9 in a raised position.
Figure 10B:
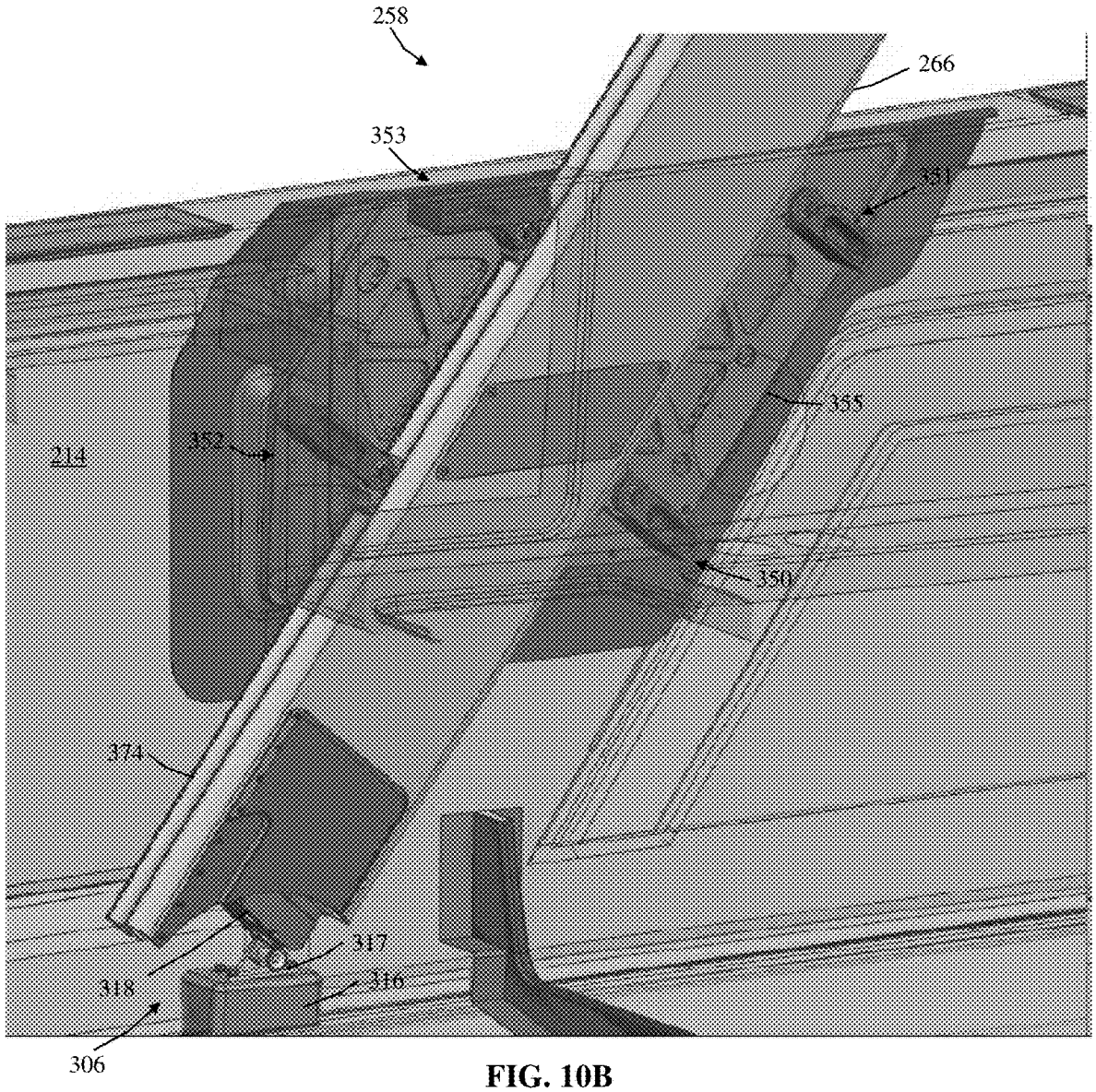
FIG. 10B is a partial perspective view of an adjustable tower assembly of FIG. 9 in a lowered position.

With reference to FIG. 10A and FIG. 10B, the adjustable tower assembly 258 includes an actuation assembly 306 coupled to the first support 266. As detailed previously herein, the actuation assembly 306 is configured to move the support 266 and the roof 262 between a plurality of positions. In the illustrated embodiment, the support 266 is movable between a raised position (FIG. 10A) and a lowered position (FIG. 10B) in response to activation of the electric motor 318. Actuation assembly 306 includes a base 310 coupled to the hull 214 and an extension member 314 (shown in FIG. 9) movable with respect to the base 310. In the illustrated embodiment, base 310 is secured to an internal surface of the hull 316 with a pivoting bracket 317 and fasteners.

Figure 11:
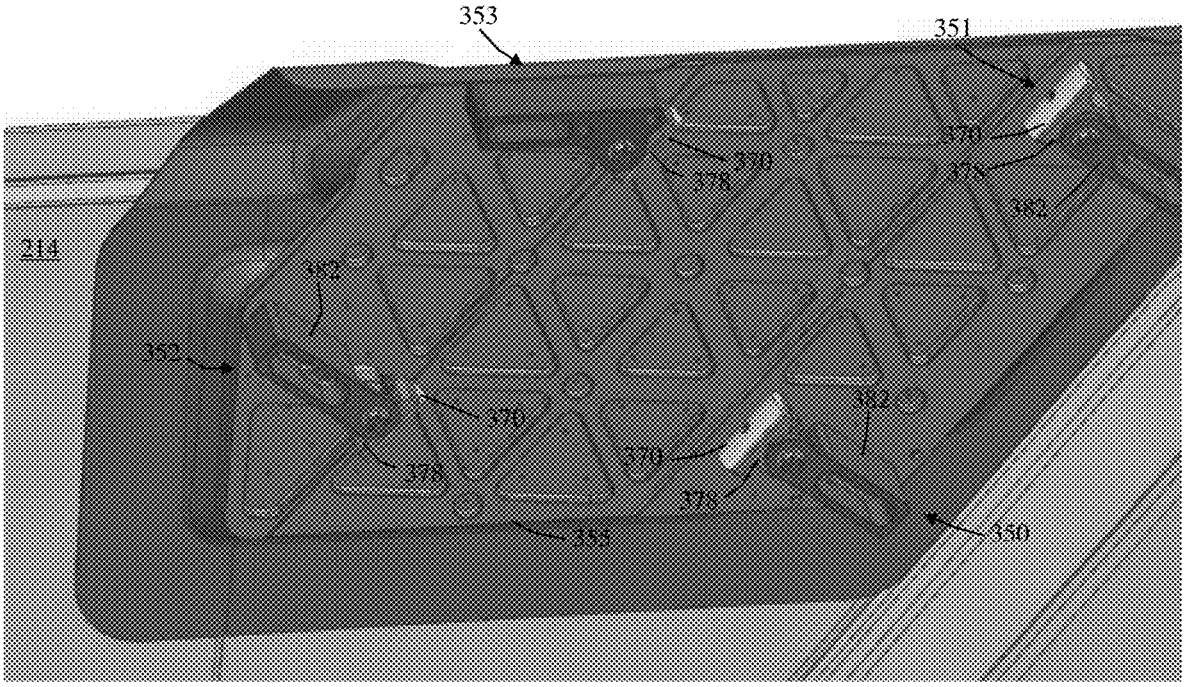
FIG. 11 is a partial perspective view of the hull panel and four brace assemblies.

With reference to FIG. 11, the hull panel 355 and plurality of brace assemblies 350, 351, 352, 353 are shown. In the illustrated embodiment, hull panel 355 is formed of a single part but may be formed of several coupled parts which collectively form a hull panel. In the illustrated embodiment, hull panel 355 is coupled to the hull 214 using fasteners, but may be coupled using adhesives, by welding, or any other mechanical means, or may be formed integrally with the hull 214 itself. In the illustrated embodiment, hull panel 355 is shown with a series of divots or depressions in order to reduce the overall weight of the panel 355 while maintaining a high degree of structural rigidity.

Figure 12:
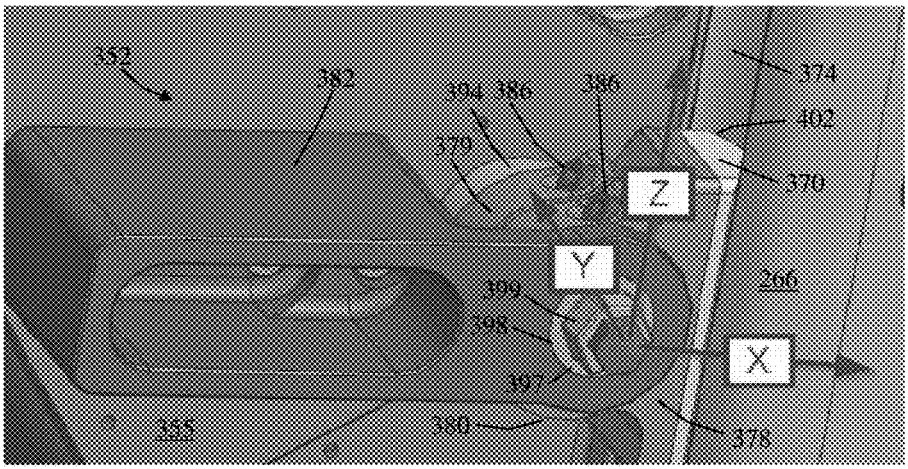
FIG. 12 is a partial perspective view of a brace assembly.
Figure 13:
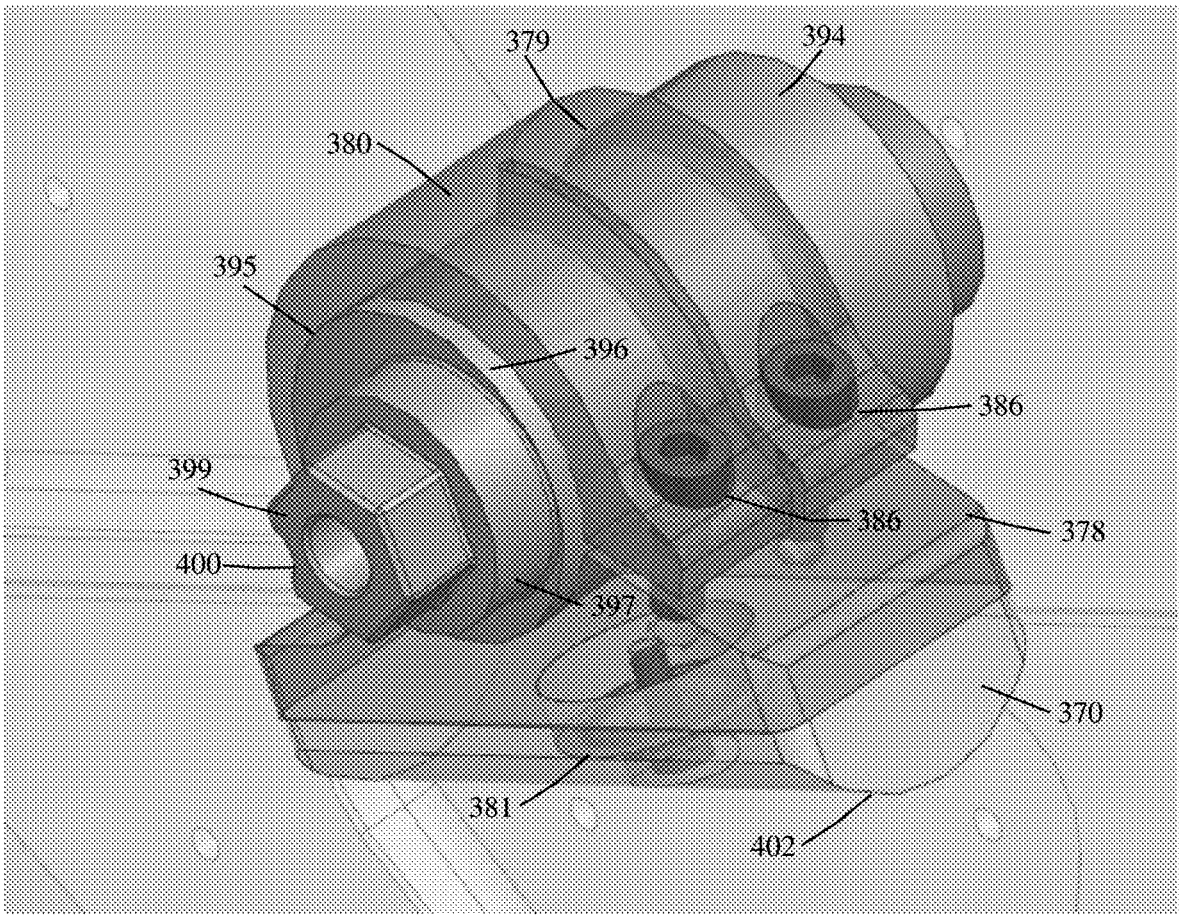
FIG. 13 is a partial perspective view of a brace assembly without a bracket.
Figure 14A:
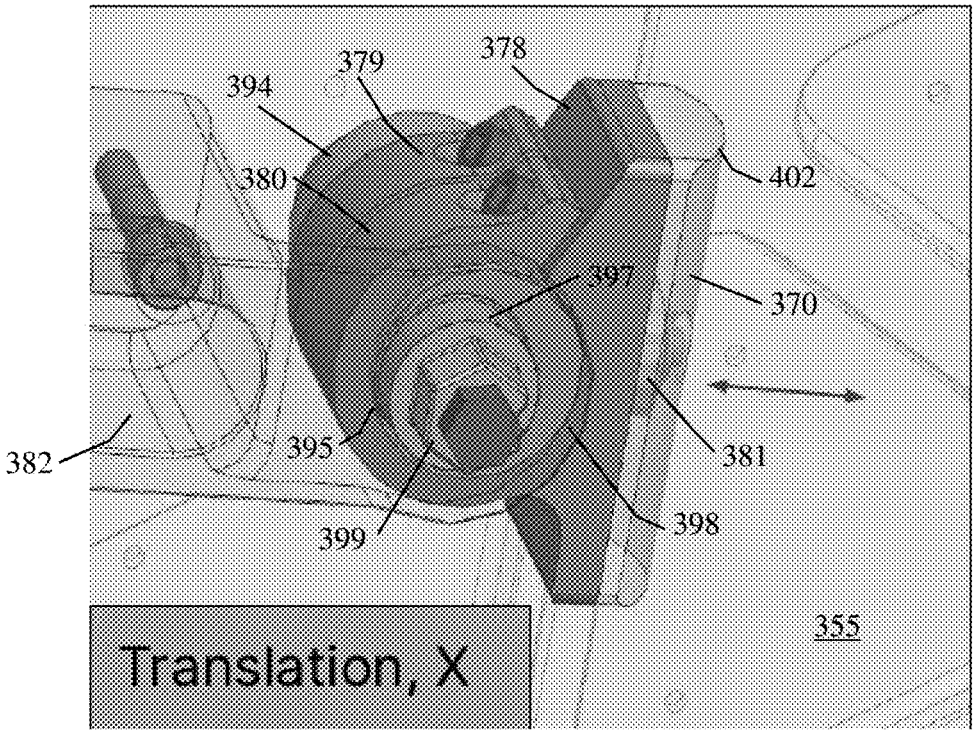
FIG. 14A is a partial perspective view of a brace assembly in a first position along the x axis.
Figure 14B:
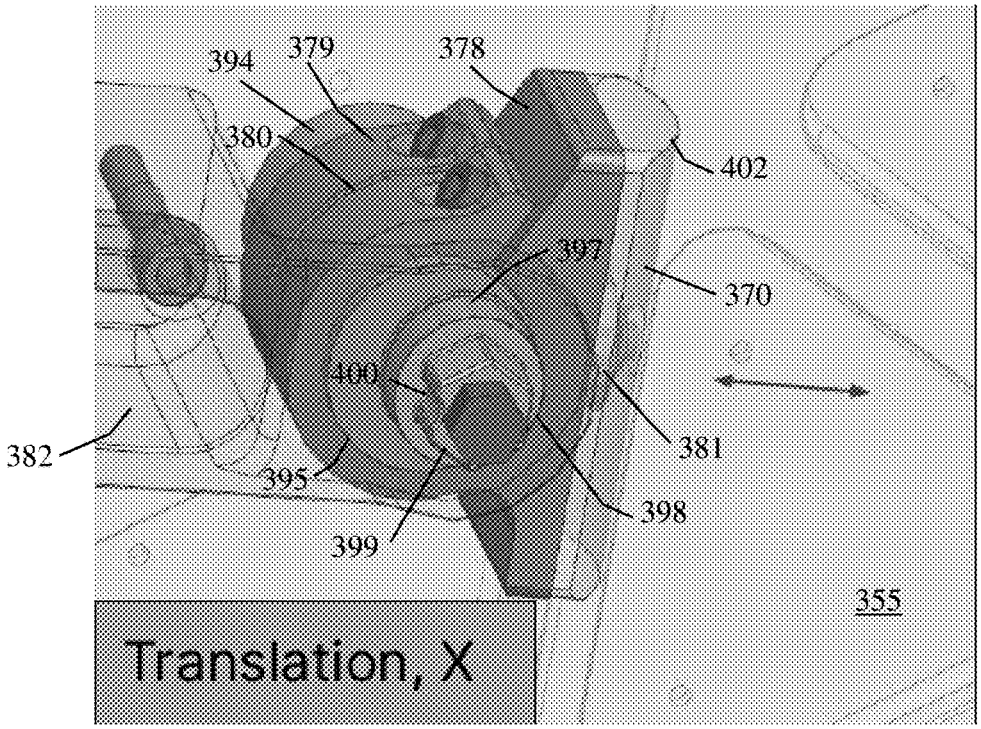
FIG. 14B is a partial perspective view of the brace assembly of FIG. 14A in a second position along the x axis.
Figure 15A:
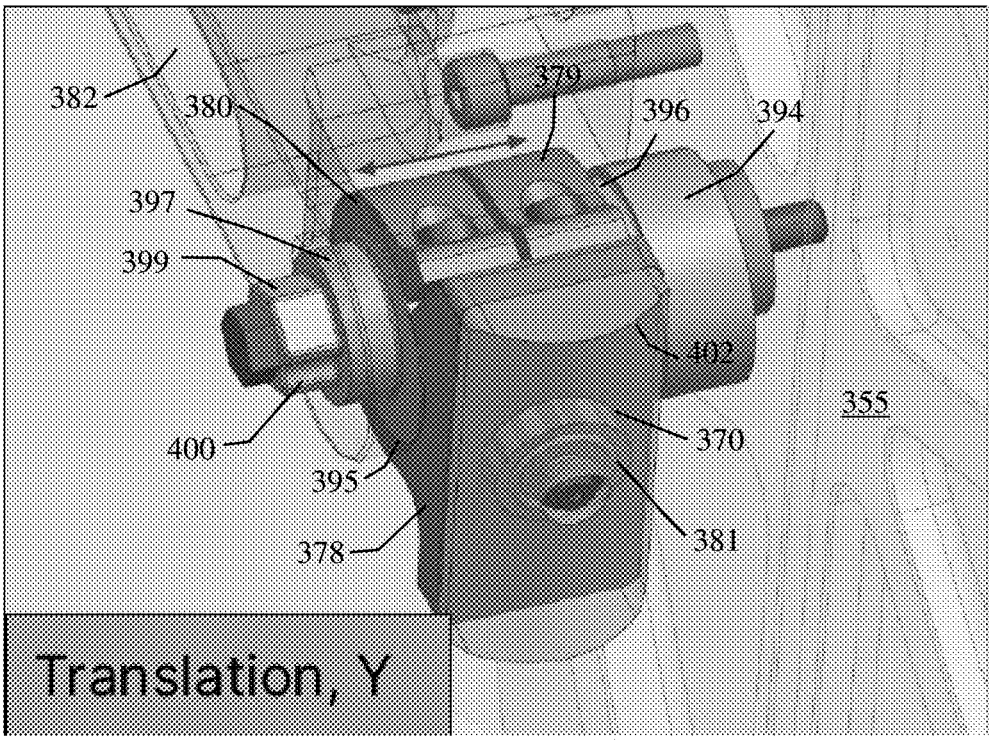
FIG. 15A is a partial perspective view of a brace assembly in a first position along the y axis.
Figure 15B:
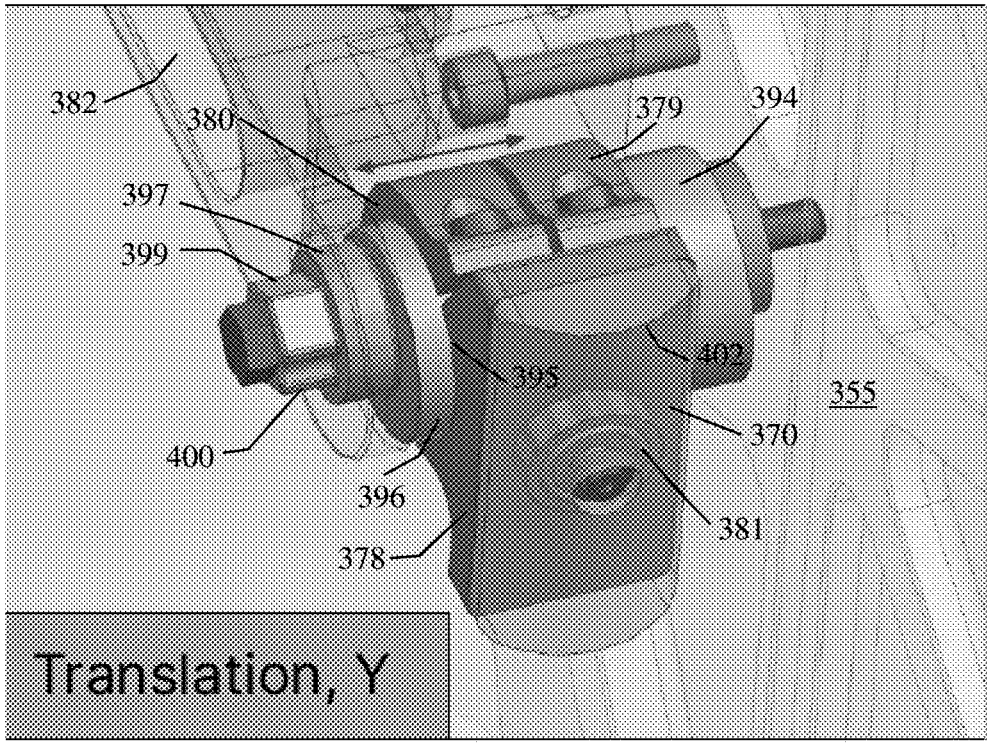
FIG. 15B is a partial perspective view of the brace assembly of FIG. 15A in a second position along the y axis.

With reference to FIG. 12 and FIG. 13, a brace assembly 352 is shown along with the three orthogonal axes (x, y, z) that define six degrees of freedom relative to the support 266. The brace assembly 352 includes a bearing 370 positioned at least partially within a groove 374 formed in the support 266. The bearing 370 is slidable along groove 374 and provides the assembly's first degree of freedom (translation along the z axis). The brace assembly 352 further includes a block 378 and a bracket 382, and an eccentric pin 394 coupled between block 378 and bracket 382 within a receiving area 395. In the illustrated embodiment, the receiving area 395 is formed by the base of the block 378 and two arms 379, 380 configured to releasably clamp the eccentric pin 394 into position. Two pinch bolts in apertures 386 provide the pinching force necessary to secure the eccentric pin 394 in place. In the illustrated embodiment, the bearing 370 is coupled to block 378 along a planer surface using a single fastener and is rotatable about a boss 381 configured to nest within a corresponding recess formed within the bearing 370.

With continued reference to FIG. 13, the eccentric pin 394 and select surrounding components are shown. The eccentric pin 394 includes a barrel portion 396 nested within the arms 379, 380 of the block 378, and a cylindrical portion 397 extending from one end of the barrel portion 396, such that its central axis is spaced some distance away (i.e. offset) from the central axis of the barrel portion 396. The cylindrical portion 397 is configured to rotatably fit within an aperture 398 formed within the bracket 382. In the illustrated embodiment, the eccentric pin 394 includes a raised hexagonal portion 399 extending from the circular face of the cylindrical portion 397 opposite the barrel 396 and includes a detent 400 to provide indexing and aid in this adjustment.

With reference to FIGS. 14-18, the brace assemblies' remaining five degrees of freedom are shown. Translation along the x axis is demonstrated in FIGS. 14A and 14B. This adjustment is achieved by rotating the eccentric pin 394 relative to the block 378 and bracket 382. Positioning the cylindrical portion 397 left of the eccentric pin's central axis effectively shortens the brace assembly 352 and moves bearing 370 away from the groove 374 (FIG. 14A), while positioning the cylindrical portion 397 to the right effectively lengthens the brace assembly 352 and moves the bearing 370 towards the groove 374 (FIG. 14B). Translation along the y axis is achieved by loosening the pinch bolts and sliding the eccentric pin 394 along its barrel portion 396 (perpendicular to the bracket's major axis). This adjustment allows for the bearing 370 to be positioned further away from the hull panel 355 (FIG. 15A), or more towards the hull panel 355 (FIG. 15B).

Figure 16A:
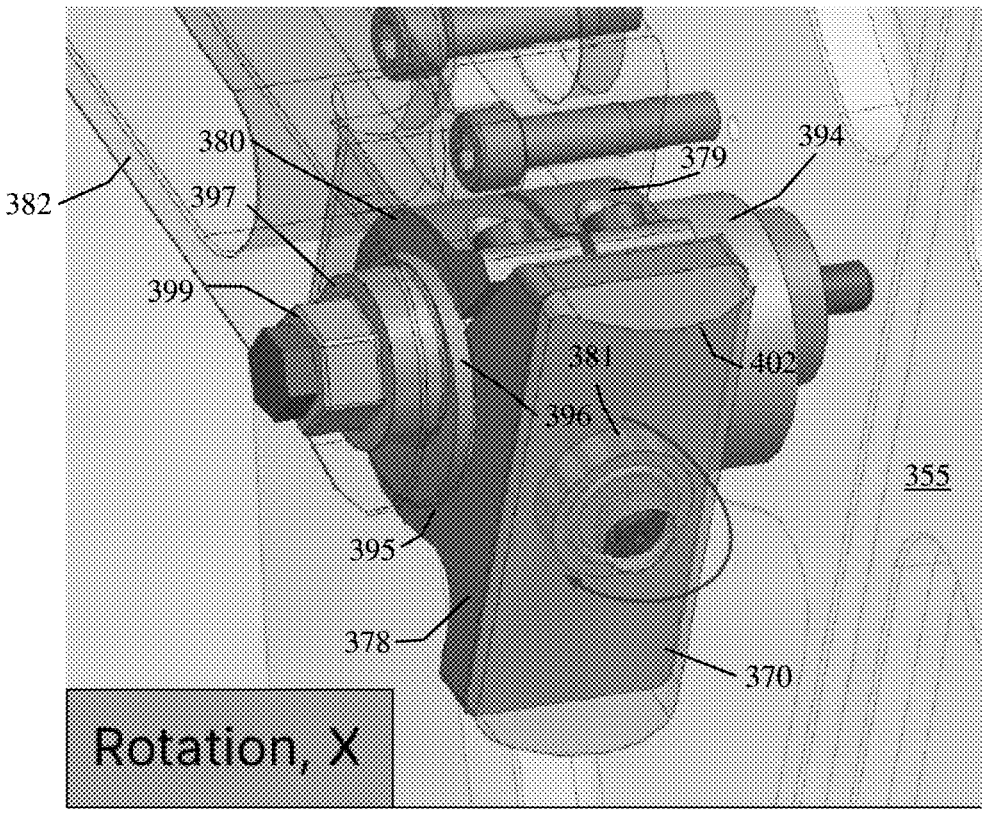
FIG. 16A is a partial perspective view of a brace assembly in a first rotational position about the x axis.
Figure 16B:
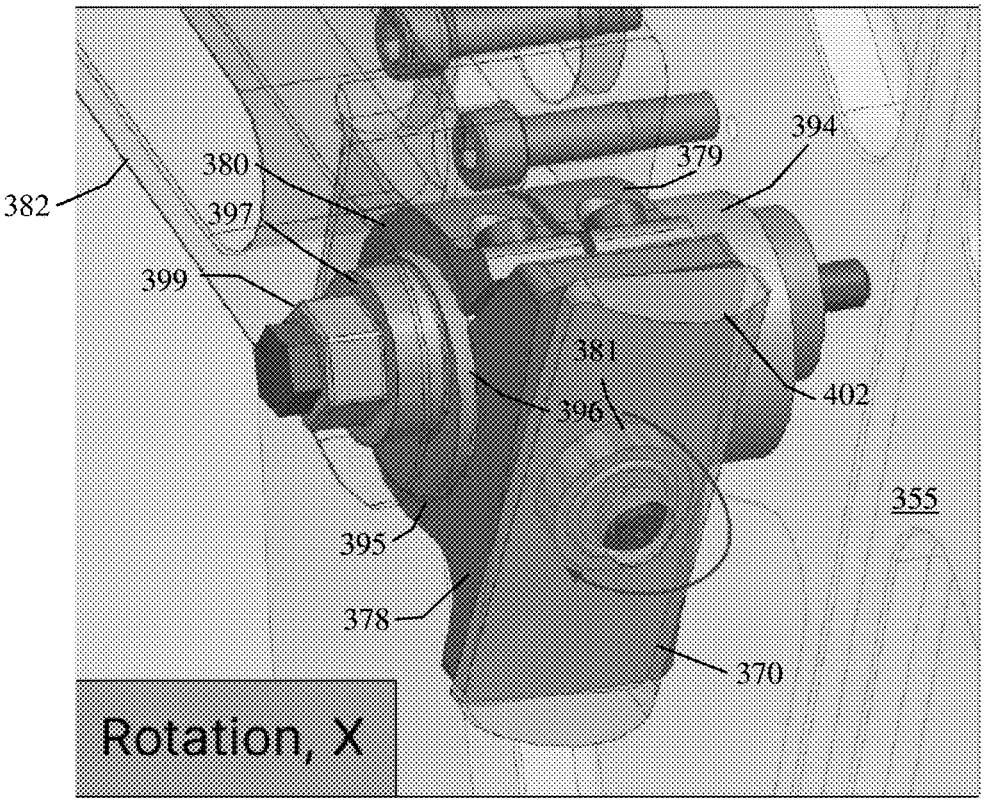
FIG. 16B is a partial perspective view of the brace assembly of FIG. 16A in a second rotational position about the x axis.
Figure 17A:
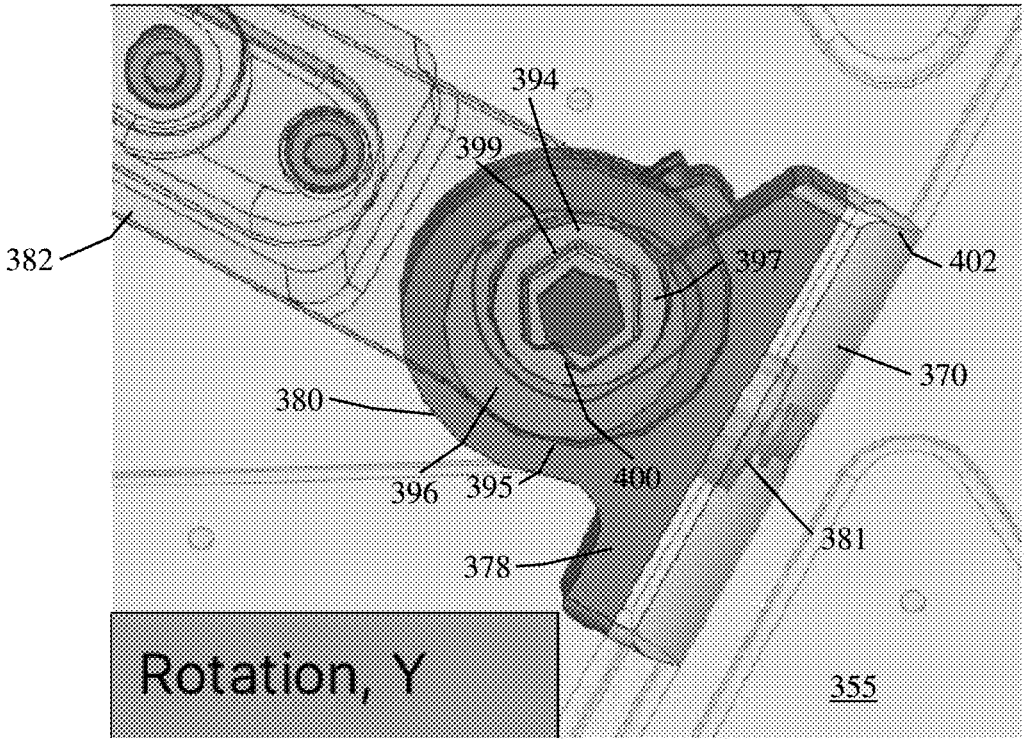
FIG. 17A is a partial perspective view of a brace assembly in a first rotational position about the y axis.
Figure 17B:
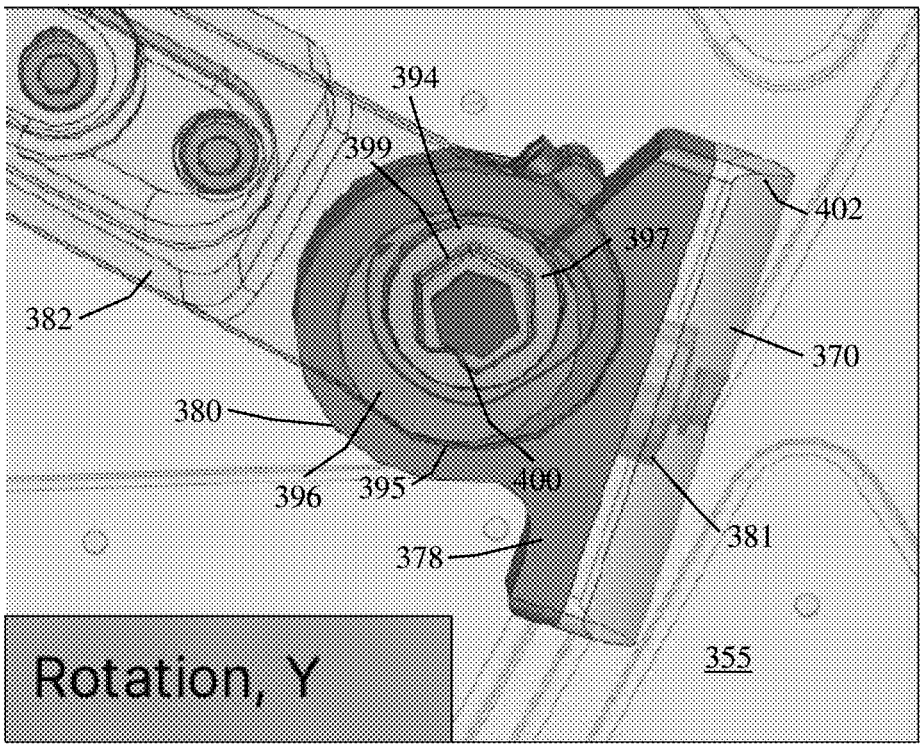
FIG. 17B is a partial perspective view of the brace assembly of FIG. 17A in a second rotational position about the y axis.
Figure 18A:
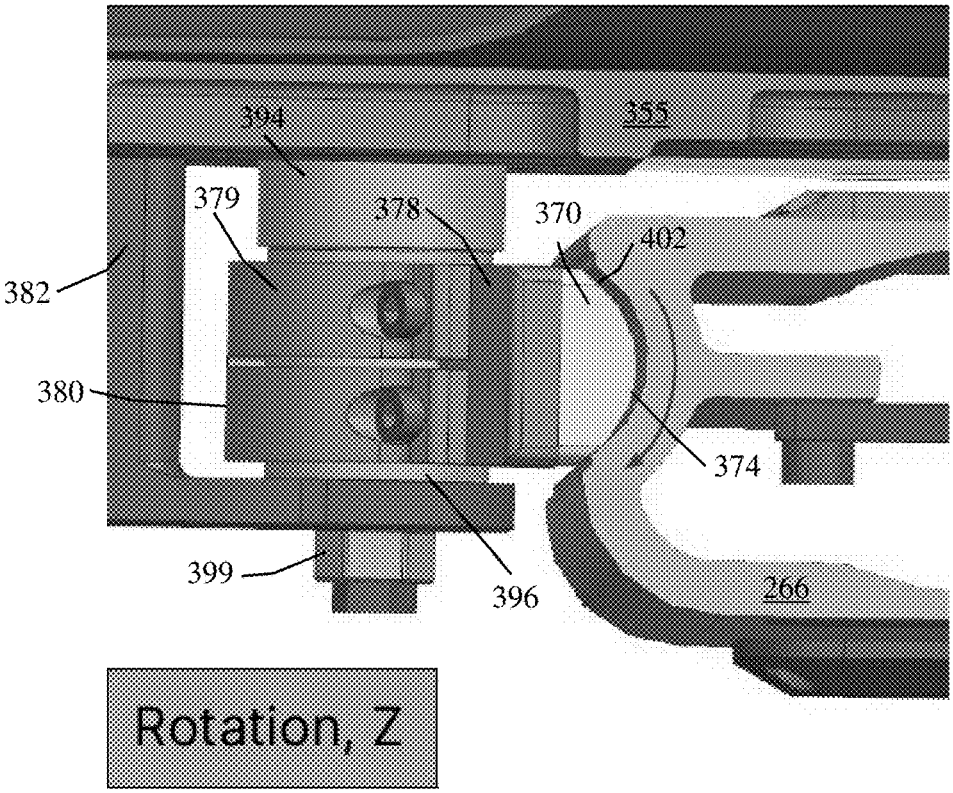
FIG. 18A is a partial perspective view of a brace assembly in a first rotational position about the z axis.
Figure 18B:
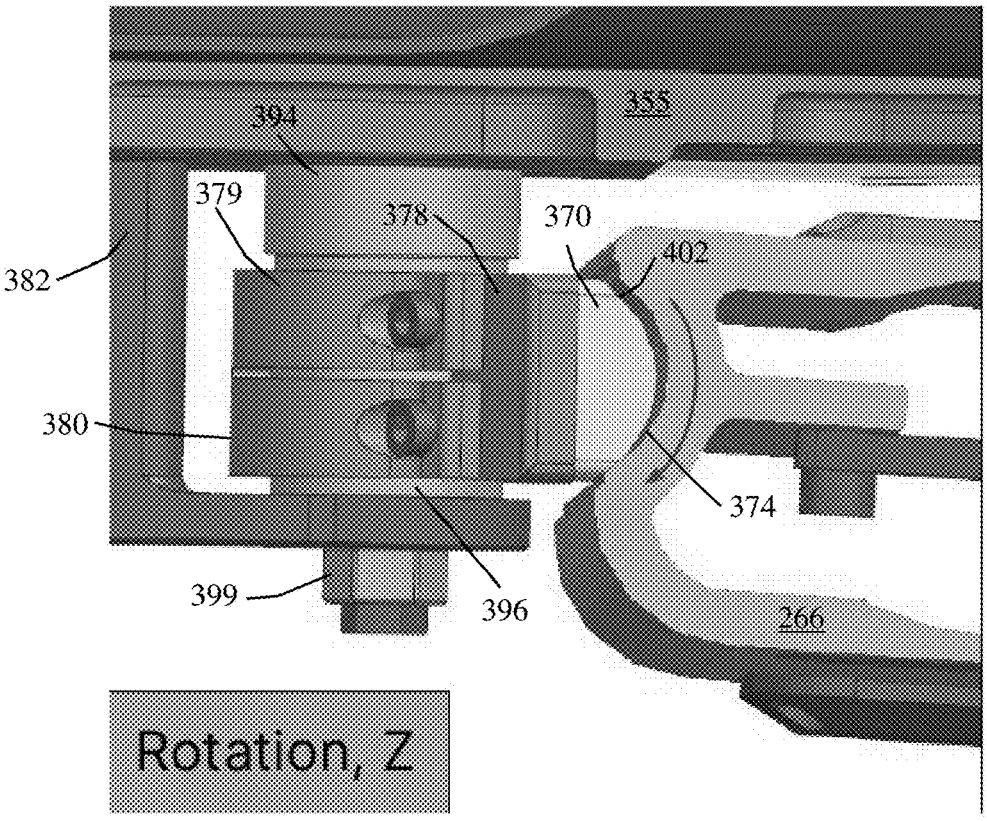
FIG. 18B is a partial perspective view of the brace assembly of FIG. 18A in a second rotational position about the z axis.

In addition to three translational degrees of freedom, the bearing 370 may be rotated about the three axes to account for a wider range of misalignments between the bearing 370 and the groove 374. Because the bearing 370 is secured to the block 378 using a single centrally positioned fastener located at the boss 381, the bearing 370 is able to rotate about the x axis from a position where its major axis is parallel to the z axis (FIG. 16A) to one where it is at an oblique angle (FIG. 16B). FIGS. 17A and 17B show how the block 378 and bearing 370 may be rotated about the y axis relative to the bracket 382 from a position where the bearing 370 is substantially perpendicular to the bracket 382 (FIG. 17A) to a position where the bearing 370 is at an oblique angle to the bracket 382 (FIG. 17B). The shape of bearing 370 and the groove 374 provide the remaining degree of rotational freedom as shown in FIGS. 18A and 18B. The convex mating surface 402 of the bearing 370 and the concave mating surface of the groove 374 are formed of the same arcuate shape, allowing the two surfaces to maintain contact with each other across range of relative mating angles. In the illustrated embodiment, the arcuate shape is substantially cylindrical.

Figure 19:
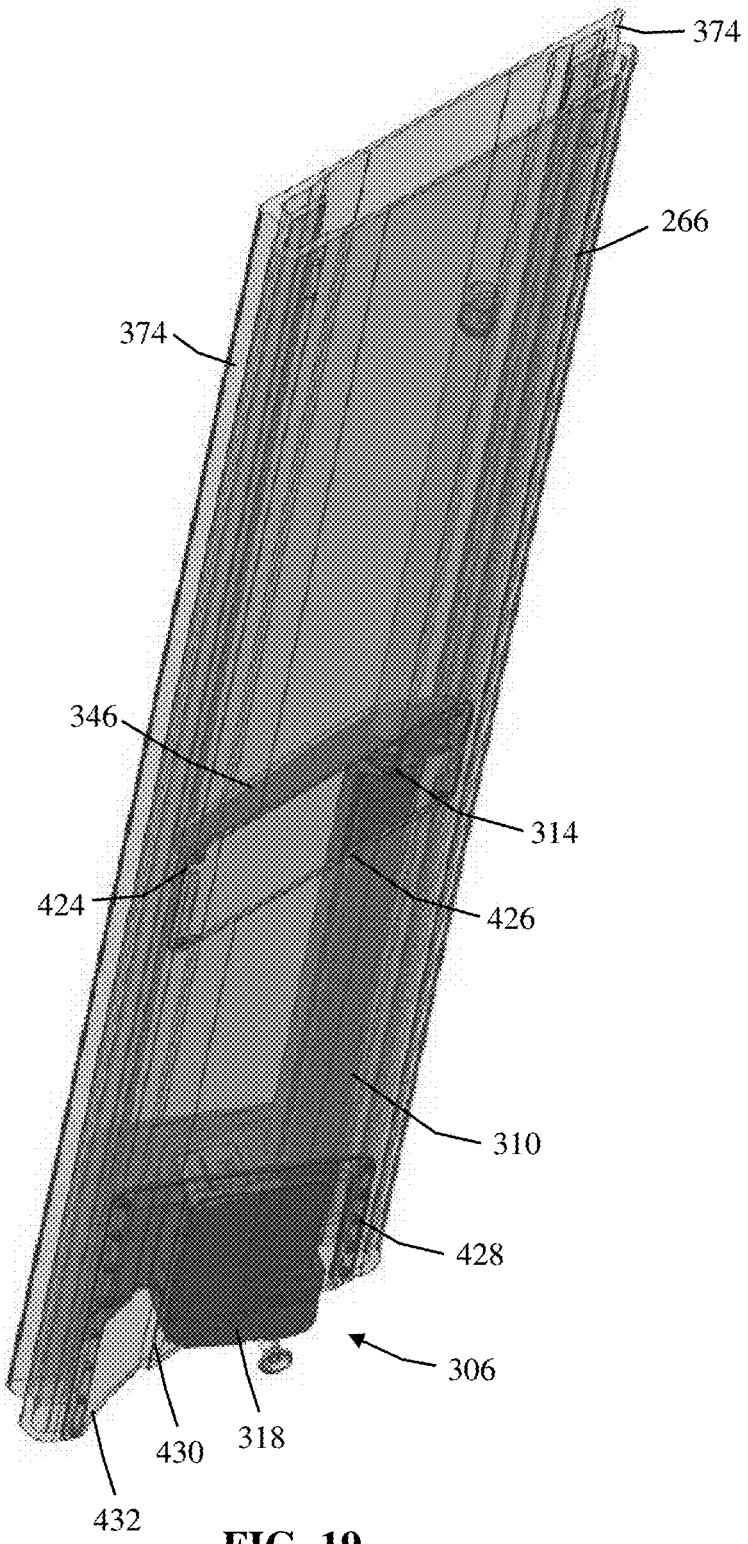
FIG. 19 is a partial perspective view of a support including an extrusion and actuation assembly with the support shown in transparency.
Figure 20:
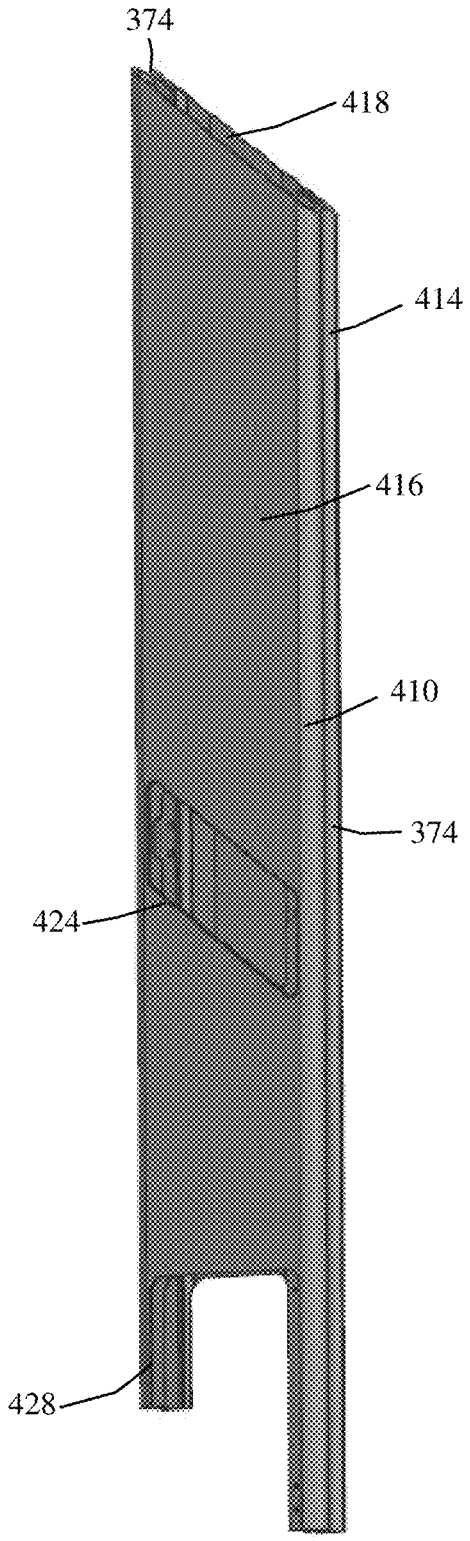
FIG. 20 is a partial perspective view of an extrusion.

With reference to FIGS. 19, a support 266, including an extrusion 410 and actuation assembly 306, is shown in a lowered position. The support 266 is shown in transparency so as to view the relative position of the actuation assembly 306. As previously discussed herein, the actuation assembly 306 includes a base 310 coupled to the hull 214 and an extension member 314 movable with respect to the base 310. In the illustrated embodiment, the base 310 includes an electrical motor 318, and the extension member 314 extends and retracts with respect to the base 310 in response to activation of the electric motor 318. The actuation assembly 306 further includes a bracket 346 coupled to the extension member 314 and coupled to the support 266. In other words, the bracket 346 connects the extension member 314 to the support 266.

With reference to FIGS. 20-24, an extrusion 410 is shown. The extrusion includes a first rail 412, a second rail 414 opposite the first, and a pair of plates 416, 418 connecting the two rails 412, 414 on opposing sides, all of which collectively form an internal cavity 420. As shown more clearly in the cross-sectional view provided in FIG. 21 and FIG. 24, the two plates 416, 418 have a thinner relative wall thickness than the two rails 412, 414. In some embodiments, the extrusion includes a transitional section 422, having a greater thickness than the plates 416, 418, positioned between each of the plates and their respective neighboring rails. Within the cavity 420, a pair of flanges 424, 426 are positioned and extend inwards from the first rail 412 and second rail 414 respectively. In the illustrated example, flanges 424, 426 are of constant width and thickness and span the length of the extrusion 410. The flanges 424, 426 are secured to the bracket 346 connecting the extrusion 410 to an extension member 314.

Figure 21:
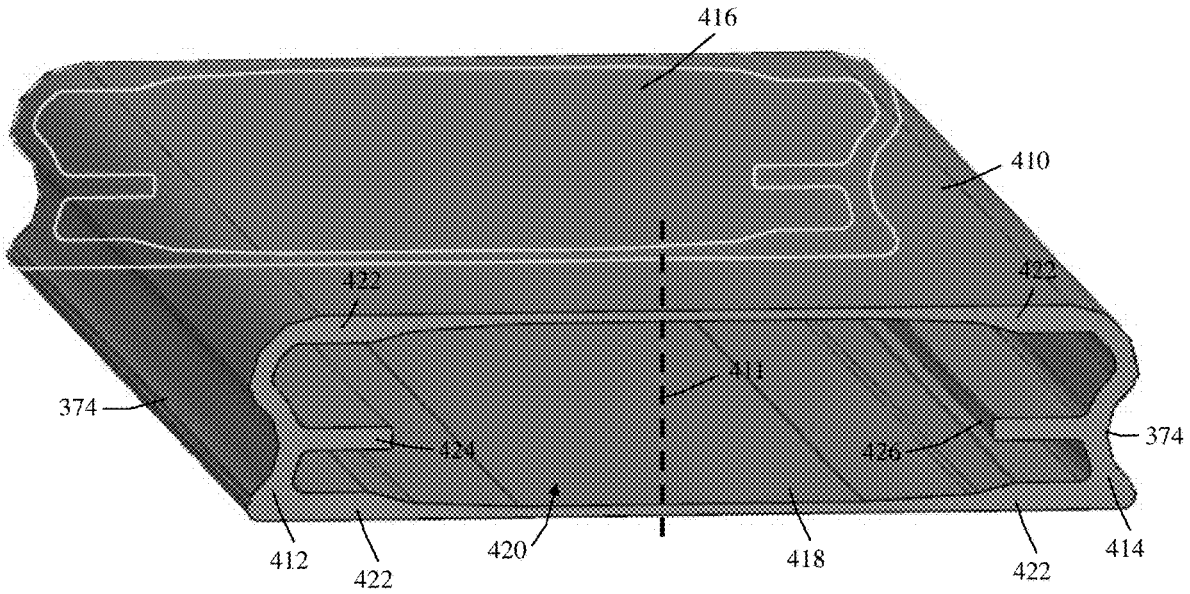
FIG. 21 is a cross-sectional view of the extrusion of FIG. 20.
Figure 22:
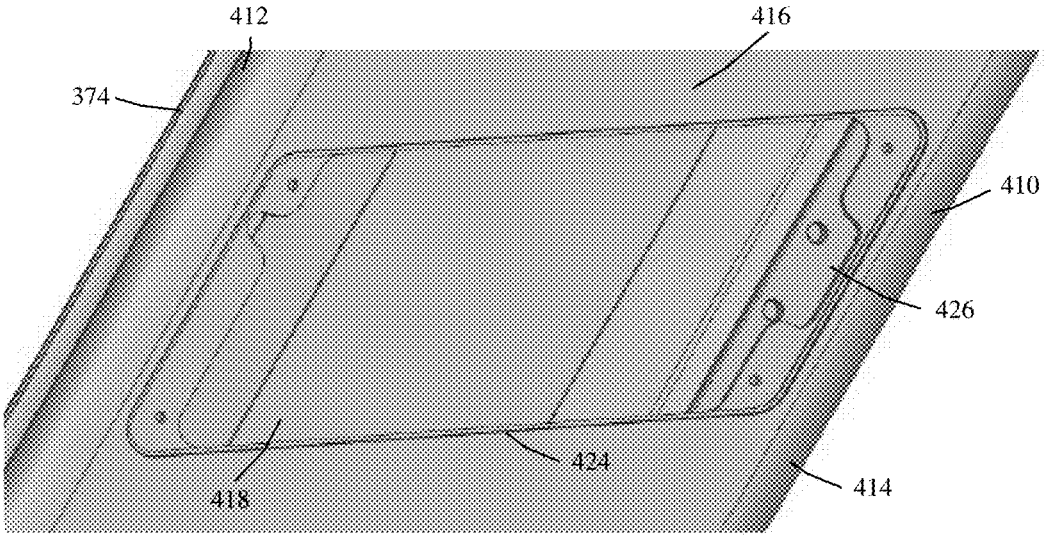
FIG. 22 is a partial perspective view of the extrusion of FIG. 20 and access aperture.
Figure 23:
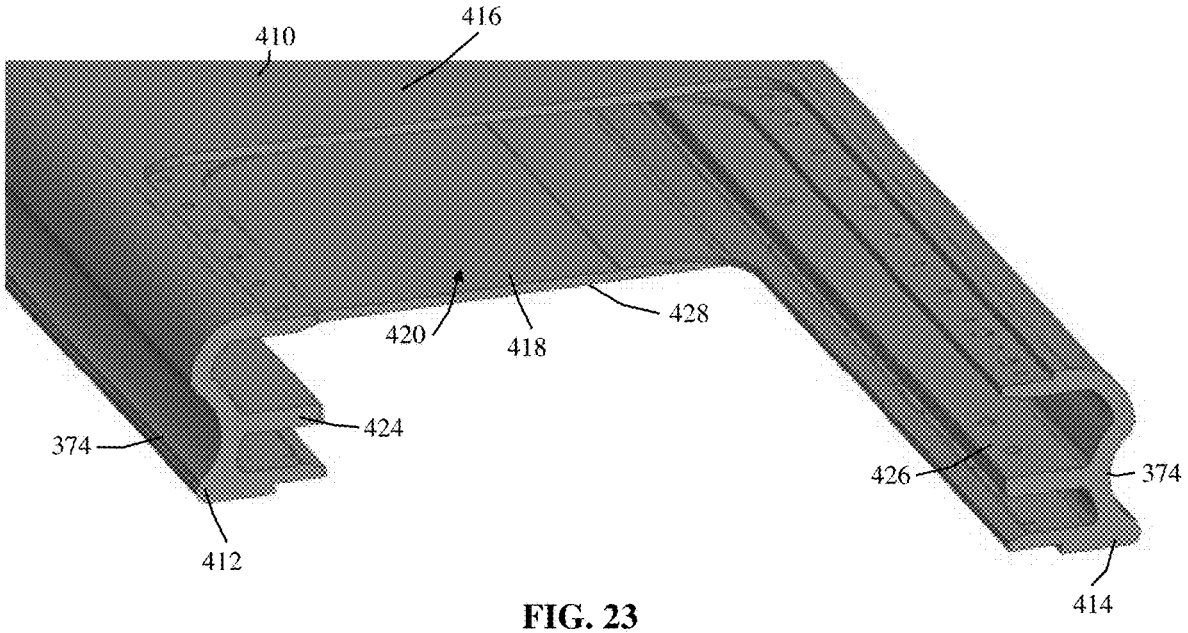
FIG. 23 is a partial perspective view of the extrusion of FIG. 20 and actuator aperture.
Figure 24:
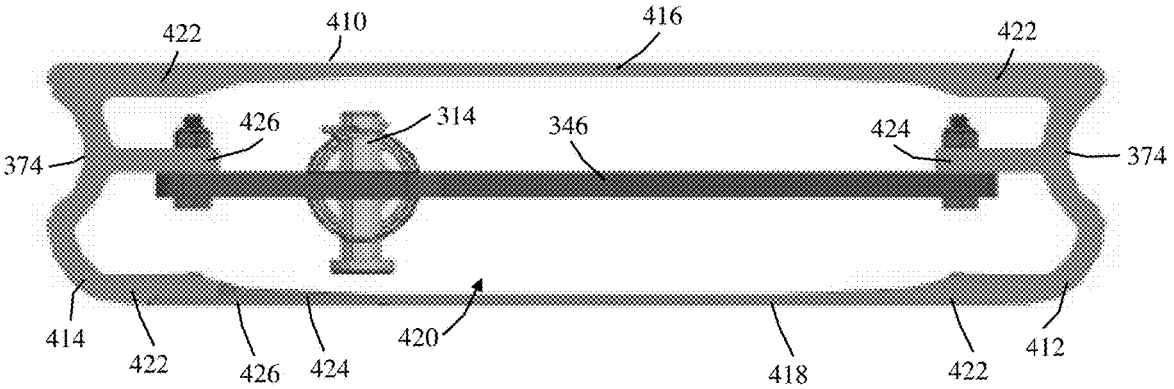
FIG. 24 is a cross-sectional view of a support and select components of the actuator assembly.

As shown in FIG. 21, the extrusion's 410 cross section is substantially symmetrical about its minor axis 411 (orthogonal to the first side plate 416 and the second side plate 418). In some embodiments, the extrusion includes an access aperture 424 formed in the first side plate 416 and a cover 426 positioned at least partially over the access aperture 424. In some embodiments, the extrusion includes an actuator aperture 428 formed in the first side plate 416 sized to accommodate the lower portion of the actuator assembly 306, and a cover 430 positioned at least partially over the actuator aperture 428. In some embodiments, the covers 426, 430 are secured to the first plate 416 using removeable fasteners. In some embodiments, the cover 430 positioned over the actuator aperture 428 includes an expanded region 432 that extends from the first side plate 316 (shown in FIG. 19).

Figure 25:
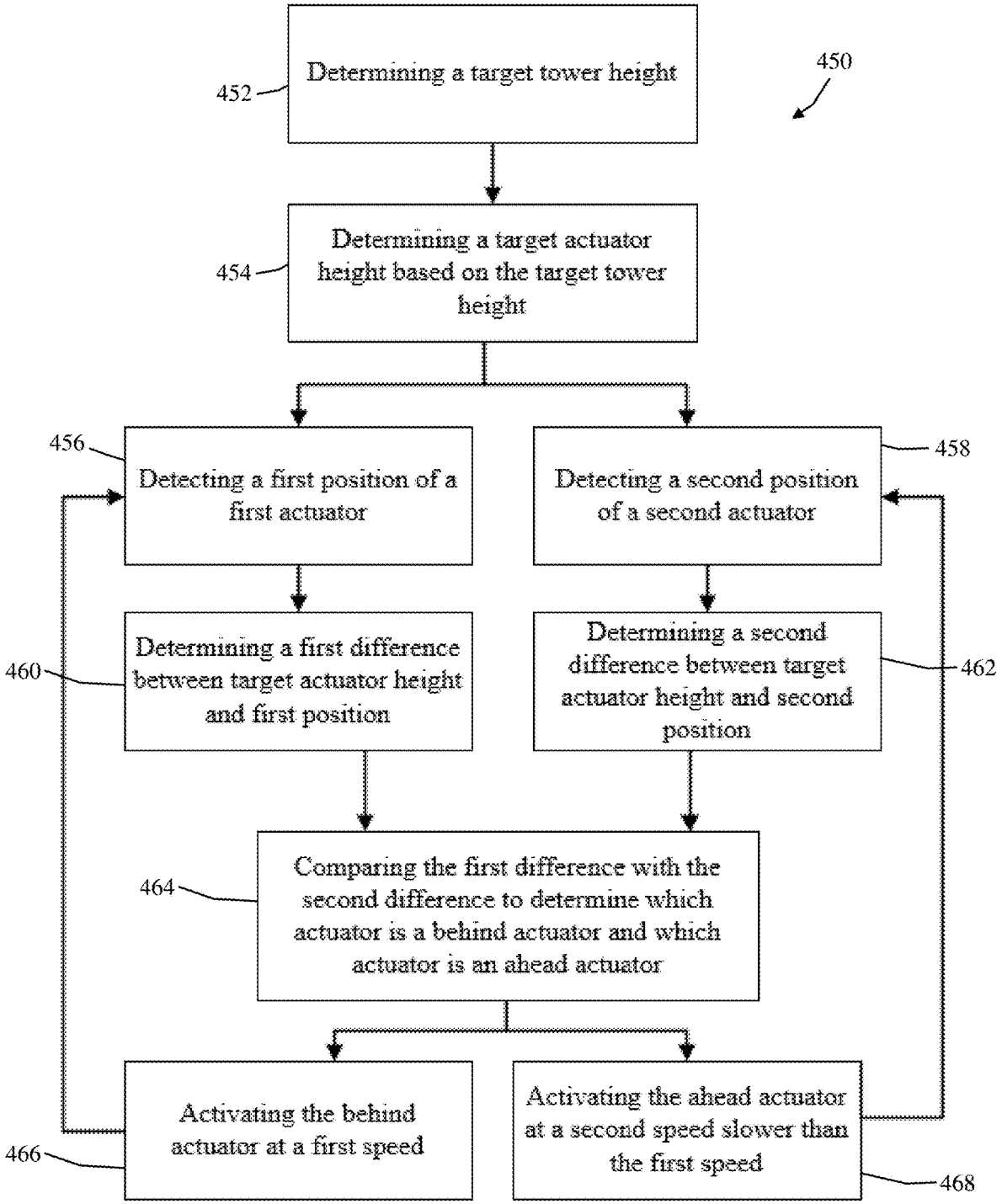
FIG. 25 is a flow chart illustrating a method of controlling a tower assembly for a watercraft.

With reference to FIG. 25, a flowchart describing a method 450 for controlling a watercraft assembly tower is provided. In some embodiments, it may be desirable for each actuator to be configured to move independently and to dynamically adjust its respective speed when adjusting position of the roof in order to prevent the assembly from warping or from experiencing an undesired torsional load. The disclosed method provides a means to accomplish such a function and begins by determining a target tower height based upon user input 452. Once the target tower height is determined, a target actuator height is determined corresponding to the target tower height 454. Then, simultaneously, the actual current height of both the first actuator and second actuator, positioned within the hull, is detected 456, 458 and compared to the corresponding target heights to determine a first difference and a second difference 460, 462. In some embodiments, electronic sensors are used to detect the relative positions of the actuators. The first difference and the second difference are then compared to determine which one of the first actuator and the second actuator is a behind actuator and which one is an ahead actuator 464. Finally, the two actuators are activated at different proportional speeds corresponding to each actuators' difference up to a maximum speed 466, 468. The method may be repeated as necessary to achieve the desired result. In some embodiments, the actuator assembly includes load sensors configured to detect the load experienced by each extension member, and the method would further include detecting said load and deenergizing the corresponding actuator if the experienced load exceeds a certain predetermined threshold.

Various features and advantages are set forth in the following claims.

What is claimed is:

1. A watercraft comprising:

a hull;

a roof;

a support including a first end coupled to the roof and a second end positioned within the hull; wherein the support includes a first rail, a second rail, a first side plate positioned between the first rail and the second rail, and a second side plate positioned between the first rail and the second rail; and an actuation assembly coupled to the support; wherein the support is moveable between a first position and a second position in response to activation of the actuation assembly; and wherein the support extends into the hull a first distance in the first position and a second distance in the second position; wherein the second distance is larger than the first distance.

2. The watercraft of claim 1, wherein the actuation assembly includes:

a base coupled to the hull;

an extension member movable with respect to the base; and a bracket coupled to the extension member and coupled to the support.

3. The watercraft of claim 1, wherein a cavity is at least partially formed by the first rail, the second rail, the first side plate, and the second side plate; and wherein the actuation assembly is at least partially positioned within the cavity.

4. The watercraft of claim 1, further including a windshield coupled to the hull;

wherein the roof abuts the windshield when the support is in the second position.

5. The watercraft of claim 1, wherein the support is movable to a third position between the first position and the second position.

6. The watercraft of claim 1, wherein the support extends through an aperture in a top edge surface of the hull.

7. The watercraft of claim 1, wherein the support extends from the hull at an angle with the support in the first position and the second position.

8. The watercraft of claim 1, further including a brace assembly positioned within the hull and coupled to the support.

9. The watercraft of claim 8, wherein the brace assembly includes a bearing positioned at least partially within a groove formed in the support.

10. The watercraft of claim 9, wherein the brace assembly further includes a block and a bracket, wherein the bearing is coupled to the block; and wherein the block is coupled to and movable with respect to the bracket.

11. The watercraft of claim 10, wherein the block is movable with respect to the bracket along an axis orthogonal to the support.

12. The watercraft of claim 11, wherein the brace assembly further includes an eccentric pin coupled between the block and the bracket, and wherein the block moves along the axis in response to rotation of the eccentric pin.

13. The watercraft of claim 8, wherein the brace assembly is one of a plurality of brace assemblies positioned within the hull and coupled to the support; wherein at least one of the plurality of brace assemblies is positioned along a first edge of the support; and wherein at least one of the plurality of brace assemblies is positioned along a second edge of the support.

14. The watercraft of claim 1, wherein the support is a first support and the watercraft further includes a second support coupled to the roof; and wherein the actuation assembly is a first actuation assembly, and the watercraft further includes a second actuation assembly coupled to the second support.

15. The watercraft of claim 1, further including a user interface configured to receive a user input; and wherein the position of the roof with respect to the hull is adjusted in response to receiving the user input.

16. The watercraft of claim 1, further including a windshield coupled to the hull;

wherein the roof abuts the windshield when the support is in the second position such that a cabin is at least partially defined by the roof and the windshield.

17. The watercraft of claim 1, wherein the actuation assembly is positioned at least partially within the support;

wherein the actuation assembly extends from the second end of the support.

18. The watercraft of claim 1, wherein the second end defines an aperture and the actuation assembly extends through the aperture.

19. A watercraft comprising:

a hull;

a roof;

a support including a first end coupled to the roof and a second end positioned within the hull;

a brace assembly positioned within the hull and coupled to the support;

an actuation assembly coupled to the support; wherein the support is moveable between a first position and a second position in response to activation of the actuation assembly; and wherein the support extends into the hull a first distance in the first position and a second distance in the second position; wherein the second distance is larger than the first distance.

20. The watercraft of claim 19, wherein the brace assembly includes a bearing positioned at least partially within a groove formed in the support.

21. The watercraft of claim 20, wherein the brace assembly further includes a block and a bracket, wherein the bearing is coupled to the block; and wherein the block is coupled to and movable with respect to the bracket.

22. The watercraft of claim 21, wherein the block is movable with respect to the bracket along an axis orthogonal to the support.

23. The watercraft of claim 22, wherein the brace assembly further includes an eccentric pin coupled between the block and the bracket, and wherein the block moves along the axis in response to rotation of the eccentric pin.

24. The watercraft of claim 19, wherein the brace assembly is one of a plurality of brace assemblies positioned within the hull and coupled to the support; wherein at least one of the plurality of brace assemblies is positioned along a first edge of the support; and wherein at least one of the plurality of brace assemblies is positioned along a second edge of the support.

25. The watercraft of claim 19, wherein the actuation assembly includes:

a base coupled to the hull;

an extension member movable with respect to the base; and a bracket coupled to the extension member and coupled to the support.

26. The watercraft of claim 19, further including a windshield coupled to the hull; wherein the roof abuts the windshield when the support is in the second position.

27. The watercraft of claim 19, wherein the support is movable to a third position between the first position and the second position.

28. The watercraft of claim 19, wherein the support extends through an aperture in a top edge surface of the hull.

29. The watercraft of claim 19, wherein the support extends from the hull at an angle with the support in the first position and the second position.

30. The watercraft of claim 19, wherein the support is a first support and the watercraft further includes a second support coupled to the roof; and wherein the actuation assembly is a first actuation assembly, and the watercraft further includes a second actuation assembly coupled to the second support.

31. The watercraft of claim 19, further including a user interface configured to receive a user input; and wherein the position of the roof with respect to the hull is adjusted in response to receiving the user input.

32. The watercraft of claim 19, further including a windshield coupled to the hull; wherein the roof abuts the windshield when the support is in the second position such that a cabin is at least partially defined by the roof and the windshield.

33. The watercraft of claim 19, wherein the actuation assembly is positioned at least partially within the support; and wherein the actuation assembly extends from the second end of the support.

34. The watercraft of claim 33, wherein the second end defines an aperture and the actuation assembly extends through the aperture.

* * * * *